US010481533B2

(12) United States Patent
Kurosawa

(10) Patent No.: US 10,481,533 B2
(45) Date of Patent: Nov. 19, 2019

(54) FIXING DEVICE, IMAGE FORMING SYSTEM, AND FIXING TEMPERATURE CONTROL METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Norio Kurosawa, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/234,923

(22) Filed: Dec. 28, 2018

(65) Prior Publication Data

US 2019/0278203 A1 Sep. 12, 2019

Related U.S. Application Data

(63) Continuation of application No. 15/914,747, filed on Mar. 7, 2018, now Pat. No. 10,180,645.

(51) Int. Cl.
*G03G 15/20* (2006.01)
*G03G 15/00* (2006.01)

(52) U.S. Cl.
CPC ..... *G03G 15/2039* (2013.01); *G03G 15/2064* (2013.01); *G03G 15/6558* (2013.01)

(58) Field of Classification Search
None
See application file for complete search history.

(56) References Cited

U.S. PATENT DOCUMENTS 4,498,383 A 2/1985 Pav et al.
5,046,947 A * 9/1991 Endoh ..... G03G 15/2028 219/469

(Continued)

FOREIGN PATENT DOCUMENTS

JP 2005-189308 A 7/2005
JP 2010-162701 A 7/2010

OTHER PUBLICATIONS

Notice of Allowance on U.S. Appl. No. 15/914,747 dated Sep. 10, 2018.

*Primary Examiner* — Clayton E. LaBalle
*Assistant Examiner* — Arlene Heredia
(74) *Attorney, Agent, or Firm* — Foley & Lardner LLP

(57) ABSTRACT

A fixing device includes a fixing member, a temperature measurement sensor, a movement mechanism, a movement time calculation section, a movement position calculation section, and a temperature control section. The movement mechanism moves the temperature measurement sensor to scan non-heated regions and a heated region along a width direction of the fixing member. The movement time calculation section obtains an arrival time on the basis of a temperature change measured by the temperature measurement sensor due to movement of the temperature measurement sensor. The movement position calculation section calculates the movement position on the basis of a ratio of a second movement time to a first movement time. The temperature control section performs temperature control on the fixing member on the basis of the movement position calculated by the movement position calculation section, and the temperature measured by the temperature measurement sensor.

18 Claims, 10 Drawing Sheets

(56) References Cited

U.S. PATENT DOCUMENTS

| | | | | |
|---|---|---|---|---|
| 7,054,572 | B2 * | 5/2006 | Baruch ..... | G03G 15/2042<br>219/216 |
| 2005/0207774 | A1 | 9/2005 | Sone et al. | |
| 2013/0034362 | A1 | 2/2013 | Matsuura et al. | |
| 2016/0116869 | A1 | 4/2016 | Saito et al. | |

* cited by examiner

FIXING DEVICE, IMAGE FORMING SYSTEM, AND FIXING TEMPERATURE CONTROL METHOD

CROSS-REFERENCE TO RELATED APPLICATIONS

This application is a continuation of U.S. patent application Ser. No. 15/914,747 filed Mar. 7, 2018, the entire contents of which are incorporated herein by reference.

FIELD

Embodiments described herein relate generally to a fixing device, an image forming system, and a fixing temperature control method.

BACKGROUND

An image forming system includes a fixing device. The fixing device thermally fixes toner onto a sheet. The fixing device includes a fixing member and a pressing member. The pressing member presses a sheet.

The temperature of the fixing member is controlled on the basis of a temperature distribution in a longitudinal direction of the fixing member. The temperature of the fixing member is more preferably detected at a plurality of locations in the longitudinal direction.

For example, the fixing device may include a plurality of temperature measurement sensors fixed to predetermined positions. However, in this case, there is a problem in that the temperature of a location where the temperature measurement sensors are not disposed cannot be measured. If the number of temperature measurement sensors is increased, there is a problem in that component cost is increased.

For example, the fixing device may move a single temperature measurement sensor in the longitudinal direction. In this case, it is necessary to perform position control of the temperature measurement sensor. However, there is a problem in that a motor which can control sensor position is expensive.

For example, there may be a configuration in which a position measurement sensor is combined with a cheap motor. However, the position measurement sensor is required to measure any position in a movement range of the temperature measurement sensor.

There is a problem in that the position measurement sensor requires a large installation space. There is also a problem in that the position measurement sensor is expensive.

DETAILED DESCRIPTION

According to an exemplary embodiment, there is provided a fixing device including a fixing member, a temperature measurement sensor, a movement mechanism, a movement time calculation section, a movement position calculation section, and a temperature control section. The fixing member has non-heated regions and a heated region. The non-heated regions are formed at both end parts of the fixing member. The heated region is interposed between the non-heated regions. The temperature measurement sensor that measures the temperature of a surface of the fixing member. The movement mechanism moves the temperature measurement sensor to scan the non-heated regions and the heated region a long a width direction of the fixing member. The movement time calculation section obtains arrival times to a first end part and a second end part within a scanning range of the movement mechanism. The arrival times are obtained on the basis of a temperature change measured by the temperature measurement sensor due to movement of the temperature measurement sensor. The movement time calculation section calculates a first movement time and a second movement time. The first movement time is the time for which the temperature measurement sensor is moved between the first end part and the second end part. The second movement time is time for which the temperature measurement sensor is moved from the first end part or the second end part to a movement position of the temperature measurement sensor. The movement position calculation section calculates the movement position on the basis of a ratio of the second movement time to the first movement time. The temperature control section performs temperature control on the fixing member on the basis of the movement position and a temperature. The movement position is calculated by the movement position calculation section. The temperature is measured by the temperature measurement sensor at the movement position.

First Exemplary Embodiment

Hereinafter, a description will be made a fixing device and an image forming system according to a first exemplary embodiment with reference to the drawings.

Figure 1:
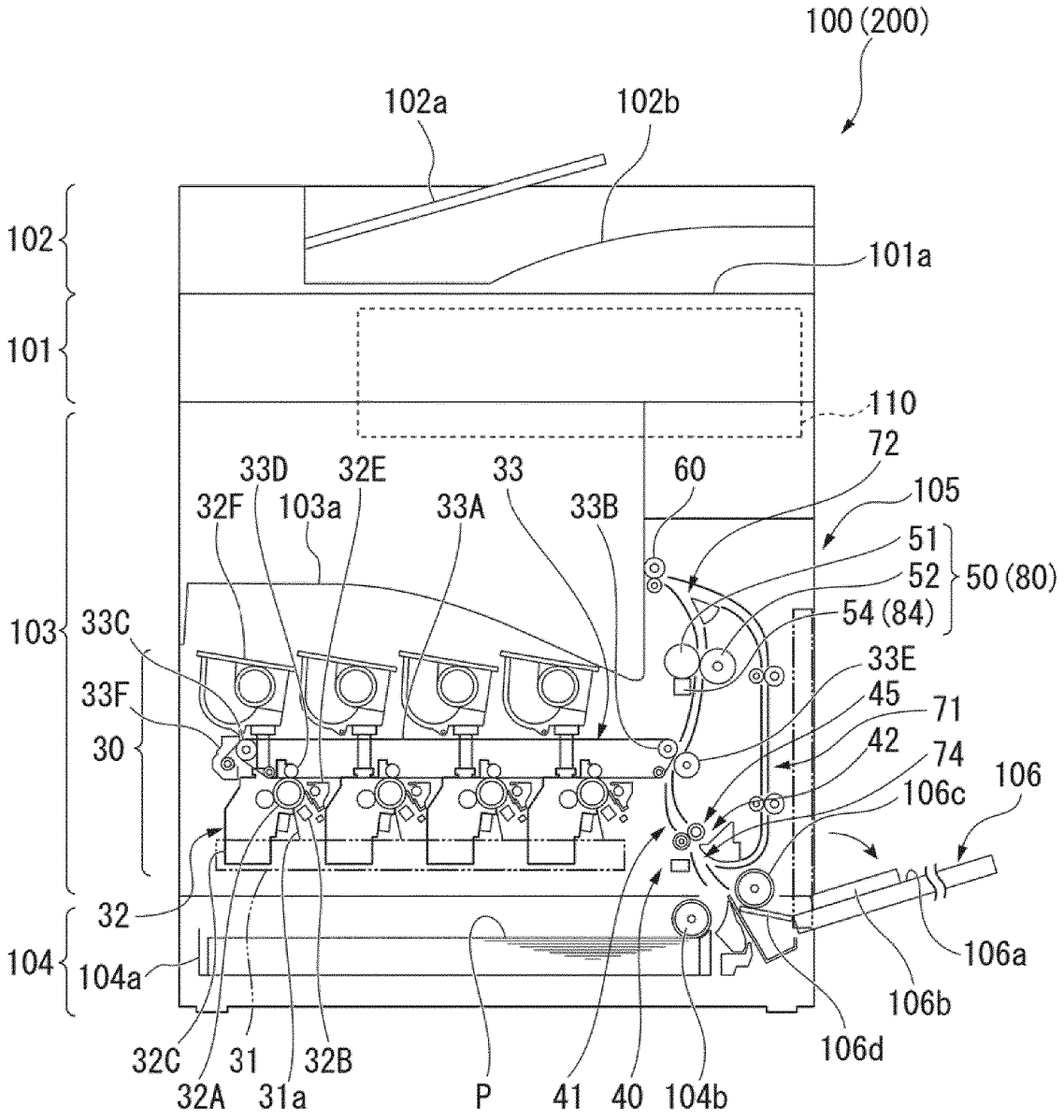
FIG. 1 is a schematic sectional view illustrating a configuration example of an image forming system of a first exemplary embodiment.

FIG. 1 is a schematic sectional view illustrating a configuration example of an image forming system of the first exemplary embodiment.

In each drawing, for better illustration, a dimension and a shape of each member are exaggerated or simplified (this is also the same for the following drawings). In each drawing, the same constituent element is given the same reference numeral unless particularly mentioned.

An image forming system 100 of the first exemplary embodiment illustrated in FIG. 1 is, for example, a multi-function peripheral (MFP), a printer, or a copier.

The image forming system 100 includes a scanner section 101, an automatic document feeder (ADF) 102, a printer section 103, a paper feeding section 104, a reversal section 105, a manual paper feeding section 106, and a controller 110.

Hereinafter, a configuration of the image forming system 100 will be described on the basis of an installation orientation in FIG. 1. The image forming system 100 in FIG. 1 is installed on a horizontal plane. A vertical direction in FIG. 1 matches a vertical plane. In the image forming system 100 in FIG. 1, a front face section of a device is directed toward the front side of the drawing surface of FIG. 1. When viewed from a direction opposite to the front face section of the image forming system 100, the right side of FIG. 1 matches the right side in the image forming system 100. When viewed from a direction opposite to the front face section of the image forming system 100, the left side of FIG. 1 matches the left side in the image forming system 100. A rear face section of the image forming system 100 is provided on a drawing surface depth side in FIG. 1 (not illustrated).

Unless particularly mentioned, terms such as front, rear, upper, lower, left, and right are used with respect to relative positions of members forming the image forming system 100 on the basis of the installation orientation of the image forming system 100. Thus, the terms such as front, rear, upper, lower, left, and right may be different from illustrated positional relationships.

The scanner section 101 reads a document (not illustrated) A platen 101*a* on which a document is placed is provided on the scanner section 101. The ADF 102 is provided on the platen 101*a*.

The ADF 102 feeds a document placed on a document placing part 102*a* to the platen 101*a* of the scanner section 101. The document fed to a document reading position of the platen 101*a* is discharged to a document discharge stand 102*b* under the document placing part 102*a*.

The scanner section 101 includes an illumination light source (not illustrated) illuminating a document, and an image sensor (not illustrated) which performs photoelectric conversion on reflected light from the document. The scanner section 101 reads information of a document fed by the ADF 102 or information of a document placed on the platen 101*a* by using the illumination light source and the image sensor.

Although not illustrated, an operation panel (operation section) used for a user to operate an operation of the image forming system 100 is provided in front of the scanner section 101 in the drawing. For example, the operation panel includes an operation panel section having various keys and a touch panel type display section.

The printer section 103 (image forming system main body) is provided above the paper feeding section 104, both of which are under the scanner section 101.

The paper feeding section 104 feeds a sheet P on which an image is to be formed to the printer section 103.

A direction in which the paper feeding section 104 moves the sheet P such that the sheet P is fed to the printer section 103 is a "first paper feeding direction". In the example illustrated in FIG. 1, the first paper feeding direction is a direction from the left side toward the right side in the drawing. A direction which is orthogonal to the first paper feeding direction in a sheet surface of sheet P is a "first paper feeding orthogonal direction".

The paper feeding section 104 includes a paper feeding cassette 104*a*. A one-stage paper feeding cassette 104*a* is provided as an example in FIG. 1. However, a plurality of paper feeding sections 104 may be provided.

The paper feeding cassette 104*a* accommodates the sheets P with various sizes with the center thereof as a reference. The sheets P with various sizes are aligned in the paper feeding cassette 104*a* such that a central axis line of a width in the first paper feeding orthogonal direction is located at a constant position.

The paper feeding section 104 includes a paper feeding roller 104*b*. The paper feeding roller 104*b* feeds the sheet P from the paper feeding cassette 104*a* toward a carrying path in the printer section 103.

A feeding method of the sheet P in the paper feeding section 104 is not particularly limited as long as a roller paper feeding method is used. Similarly, a separation method of the sheet P is not particularly limited. For example, an appropriate separation method such as a corner nail method, a separation pad method, or a separation roller method may be used.

The printer section 103 forms an image on the sheet P on the basis of image data read with the scanner section 101 or image data created with a personal computer or the like. The printer section 103 is, for example, a tandem type a color printer.

The printer section 103 includes an image forming portion 30, a carrying portion 40, a fixing device 50, and a paper discharge roller 60.

The image forming portion 30 forms an image on the sheet P by using toner with each color such as yellow (Y), magenta (M), cyan (C), and black (K).

The image forming portion 30 includes an exposure device 31, an image creation unit 32, and a transfer unit 33.

The exposure device 31 generates exposure light 31*a*. The exposure light 31*a* forms latent images corresponding to images of the respective colors on four photoconductive drums 32A included in the image creation unit 32, which will be described later.

An exposure device using laser scanning may be used as the exposure device 31. An exposure device using a solid-state scanning element such an LED may be used as the exposure device 31.

The image creation unit 32 includes the four photoconductive drums 32A which are image carriers. The respective photoconductive drums 32A are arranged to be separated from and parallel to each other from the left side toward the right side.

Each of the photoconductive drums 32A is driven to be rotated clockwise in the drawing by a drive motor (not illustrated).

The image creation unit 32 has a charger 32B, a developer 32C, and a photoconductor cleaner 32E on an outer circumference of each photoconductive drum 32A. The charger 32B, the developer 32C, and the photoconductor cleaner 32E are disposed in this order in the rotation direction of each photoconductive drum 32A.

The image creation unit 32 is disposed over the exposure device 31.

Latent images and toner images corresponding to images of respective colors such as Y, M, C, and K are formed on the four photoconductive drums 32A from the left side toward the right side.

The respective chargers 32B, the respective developers 32C, and the respective photoconductor cleaners 32E in the image creation unit 32 have the same configuration except for toner colors used to create images.

The charger 32B uniformly charges a surface of the photoconductive drum 32A.

The charged photoconductive drum 32A is irradiated with the exposure light 31*a* which is modulated on the basis of image data. An electrostatic latent image is formed on the photoconductive drum 32A.

The developer 32C has a developing roller. The developing roller supplies charged toner to the surface of the photoconductive drum 32A. If a developing bias is applied to the developing roller, the electrostatic latent image on the photoconductive drum 32A is developed with the toner.

A toner cartridge 32F is disposed over each developer 32C with the transfer unit 33 (described below) interposed therebetween. In the present exemplary embodiment, four toner cartridges 32F which respectively supply toner of the respective colors such as Y, M, C, and K are disposed.

A toner supply device (not illustrated) is provided between the toner cartridge 32F and the developer 32C. The toner in the toner cartridge 32F is supplied to the developer 32C by the toner supply device.

The photoconductor cleaner 32E removes toner remaining on the photoconductive drum 32A which was not primarily transferred by the transfer unit 33, from the surface of the photoconductive drum 32A. For example, the photoconductor cleaner 32E has a cleaning blade which is in contact with the photoconductive drum 32A. The cleaning blade removes remaining toner from the surface of the photoconductive drum 32A.

The transfer unit 33 is disposed to cover each photoconductive drum 32A from the top.

The transfer unit 33 sequentially primarily transfers the respective toner images formed on the surfaces of the photoconductive drums 32A, so as to form a primary transfer image of the toner of the respective colors. The transfer unit 33 secondarily transfers the primary transfer image onto the sheet P, so as to form a toner image on the sheet P.

The transfer unit 33 includes an intermediate transfer belt 33A, driving rollers 33B, a driven roller 33C, a primary transfer roller 33D, a secondary transfer roller 33E, and an intermediate transfer belt cleaner 33F.

The intermediate transfer belt 33A is horizontally hung on the driving roller 33B and a plurality of driven rollers 33C. The driving roller 33B is driven to be rotated counterclockwise in the drawing by a drive motor (not illustrated). If the driving roller 33B is driven, the intermediate transfer belt 33A is moved counterclockwise in the drawing in a circulating manner. The linear velocity of the intermediate transfer belt 33A is adjusted to a predefined process linear velocity.

A lower surface of the intermediate transfer belt 33A in the drawing is in contact with the upper top of each photoconductive drum 32A.

The primary transfer roller 33D is disposed at a position opposing each photoconductive drum 32A inside the intermediate transfer belt 33A.

If a primary transfer voltage is applied, the primary transfer roller 33D primarily transfers the toner image on the photoconductive drum 32A onto the intermediate transfer belt 33A.

The secondary transfer roller 33E opposes the driving roller 33B with the intermediate transfer belt 33A interposed therebetween. A contact position between the secondary transfer roller 33E and the intermediate transfer belt 33A is a secondary transfer position.

A secondary transfer voltage is applied to the secondary transfer roller 33E when the sheet P passes between the driving roller 33B and the secondary transfer roller 33E. If the secondary transfer voltage is applied, the secondary transfer roller 33E secondarily transfers the toner image on the intermediate transfer belt 33A onto the sheet P.

The intermediate transfer belt cleaner 33F is disposed near the driven roller 33C at a left end part in the drawing. The intermediate transfer belt cleaner 33F removes remaining transfer toner, which is not secondarily transferred onto the sheet P and thus remains on the intermediate transfer belt 33A, from the intermediate transfer belt 33A. For example, the intermediate transfer belt cleaner 33F includes a cleaning blade, which is in contact with the intermediate transfer belt 33A. The cleaning blade removes remaining toner from the surface of the intermediate transfer belt 33A.

The carrying portion 40 carries the sheet P fed from the paper feeding cassette 104*a* in a first carrying direction (a direction from the lower side toward the upper side in the drawing) along a first carrying path 41 in the printer section 103.

The first carrying path 41 is formed by a plurality of carrying guide members. The first carrying path 41 guides the sheet P to be carried. The first carrying path 41 is provided between the paper feeding roller 104*b* and the secondary transfer position, between the secondary transfer position and the fixing device 50, and between the fixing device 50 and the paper discharge roller 60, both of which are described below.

The fixing device 50 fixes the toner image attached to the sheet P having passed through the secondary transfer position onto the sheet P. The fixing device 50 is disposed over the secondary transfer roller 33E.

The fixing device 50 includes a fixing member 51 and a pressing member 52. The fixing member 51 and the pressing member 52 nip the sheet P advancing along the first carrying path 41 at a fixing nip. The fixing nip is formed in a stripe shape that extends so as to be longer than the maximum width of the sheet P passing in a direction (first carrying orthogonal direction) orthogonal to the first carrying direction.

The fixing member 51 heats the sheet P at the fixing nip. For example, a tubular endless belt or roller is used as the fixing member 51.

A heating source of the fixing member 51 is not particularly limited as long as the surface temperature of the fixing member 51 can be controlled to be a fixing temperature. The fixing temperature is predefined according to conditions such as the softening temperature of toner and a process linear velocity. As the fixing temperature, different target temperatures may be predetermined according to positions in the first carrying orthogonal direction.

A heating source of the fixing member 51 may employ, for example, a lamp heater, a ceramic heater, an induction heating source (IH heater), and a steel heater.

The pressing member 52 presses the sheet P at the fixing nip. For example, a tubular endless belt or roller is used as the pressing member 52.

At least one of the fixing member 51 and the pressing member 52 is driven to be rotated by a drive motor (not illustrated). If the drive motor is rotated, the sheet P nipped between the fixing member 51 and the pressing member 52 is carried in the first carrying direction at a fixing linear velocity not exceeding the process linear velocity.

A detailed configuration of the fixing device 50 of the present exemplary embodiment will be described after description of the entire configuration of the image forming system 100.

The paper discharge roller 60 is provided over the fixing device 50 at an end part of the first carrying path 41.

The first carrying path 41 is curved from the right side toward the left side over the fixing device 50 upward from the lower side in the drawing.

A paper discharge table 103*a* is disposed further toward the left side than the paper discharge roller 60 over the image forming portion 30 and under the scanner section 101.

The paper discharge roller 60 is driven to perform regular and reverse rotation by a drive motor (not illustrated).

If the paper discharge roller 60 is regularly rotated, the paper discharge roller 60 moves the sheet P advancing along the first carrying path 41 onto the paper discharge table 103*a*. If regular rotation of the paper discharge roller 60 is continuously performed, the sheet P is discharged onto the paper discharge table 103*a*.

If the paper discharge roller 60 is reversely rotated in a state in which the sheet P is entering the paper discharge roller 60, the sheet P is moved from the left side toward the right side along a path at the end part of the first carrying path 41. In this case, the paper discharge roller 60 can carry the sheet P to reversal section 105.

The reversal section 105 reversely feeds the sheet P to a resist roller 45 by switching back the sheet P passed through the fixing device 50. The reversal section 105 is used to perform duplex printing.

The reversal section 105 is disposed at a location (the right side in the drawing) facing the image forming portion 30, with the first carrying path 41 interposed therebetween.

The reversal section 105 includes a second carrying path 71.

The second carrying path 71 is formed by a plurality of carrying guide members. The second carrying path 71 guides the sheet P to be carried. The second carrying path 71 branches from the first carrying path 41 at a carrying path switching part 72 between the fixing device 50 and the paper discharge roller 60. The carrying path switching part 72 is provided with a carrying path switching member 73 which guides the sheet P to the second carrying path 71 from the first carrying path 41 during reverse rotation of the paper discharge roller 60.

The second carrying path 71 joins the first carrying path 41 at a joint part 74 between the paper feeding section 104 and the resist unit resist roller 45.

A plurality of reversal carrying rollers driven by a drive motor (not illustrated) are disposed on the path of the second carrying path 71. Each reversal carrying roller carries the sheet P in a second carrying direction. The second carrying direction is a direction toward the carrying path switching part 72 from the paper discharge roller 60 via the first carrying path 41 and toward the joint part 74 from the carrying path switching part 72 via the second carrying path 71.

The sheet P entering the first carrying path 41 from the joint part 74 advances in the first carrying direction along the first carrying path 41.

The manual paper feeding section 106 feeds the sheet P on which an image is to be formed to the printer section 103.

The manual paper feeding section 106 includes a manual paper feeding tray 106*a* and a manual guide 106*b*.

The manual paper feeding tray 106*a* is rotatably provided centering on a rotation axis line extending in a second paper feeding orthogonal direction. If the manual paper feeding tray 106*a* is not used, the manual paper feeding tray 106*a* is accommodated in a side part of the printer section 103 overlapping the reversal section 105.

The manual guide 106*b* aligns the sheets P with various sizes with the center thereof as a reference on the manual paper feeding tray 106*a*.

The manual paper feeding section 106 includes a manual paper feeding roller 106*c* and a paper feeding pad 106*d* under the reversal section 105.

The manual paper feeding roller 106*c* feeds the sheet P on the manual paper feeding tray 106*a* to the resist roller 45.

The paper feeding pad 106*d* prevents overlap feeding of the sheet P.

However, a feeding method of the sheet P in the manual paper feeding section 106 is not particularly limited as long as a roller paper feeding method is used.

The controller 110 controls an operation of each device portion of the image forming system 100 on the basis of an input operation from the operation section (not illustrated).

For example, the controller 110 includes a CPU, a read only memory (ROM), a random access memory (RAM), an input/output interface, an input/output control circuit, a paper feeding/carrying control circuit, an image forming control circuit, and a fixing control circuit.

The CPU executes a program stored in the ROM or the RAM so as to realize a processing function for image formation.

The input/output control circuit of the controller 110 controls the operation section and the display section. The operation section may employ an operation panel formed of a keyboard, a display, and the like. The display section may employ a display which displays an image, text information, and the like.

The paper feeding/carrying control circuit controls driving of the paper feeding section 104, the reversal section 105, the printer section 103, the paper discharge roller 60, and the various drive motors included in the reversal section 105.

The image forming control circuit controls operations of the ADF 102, the scanner section 101, and the image forming portion 30 on the basis of control signals from the CPU.

The fixing control circuit controls an operation of the drive motor of the fixing device 50 and the temperature of the fixing member 51 on the basis of control signals from the CPU.

Specific control performed by the controller 110 will be described focusing on fixing temperature control.

Next, the fixing device 50 will be described in detail.

Figure 2:
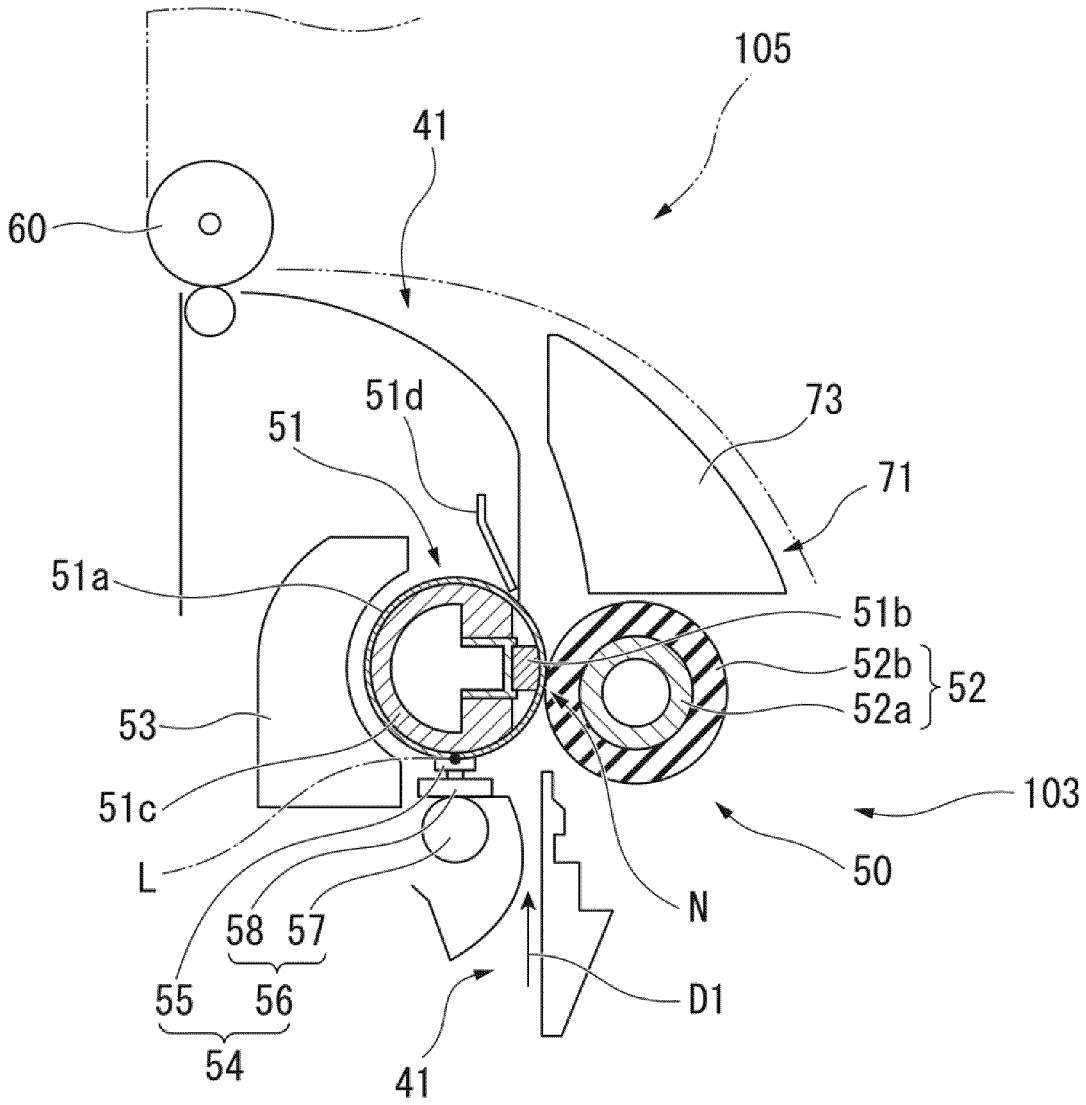
FIG. 2 is a schematic sectional view illustrating a configuration example of a fixing device.

FIG. 2 is a schematic sectional view illustrating a configuration example of the fixing device of the first exemplary embodiment.

Figure 3:
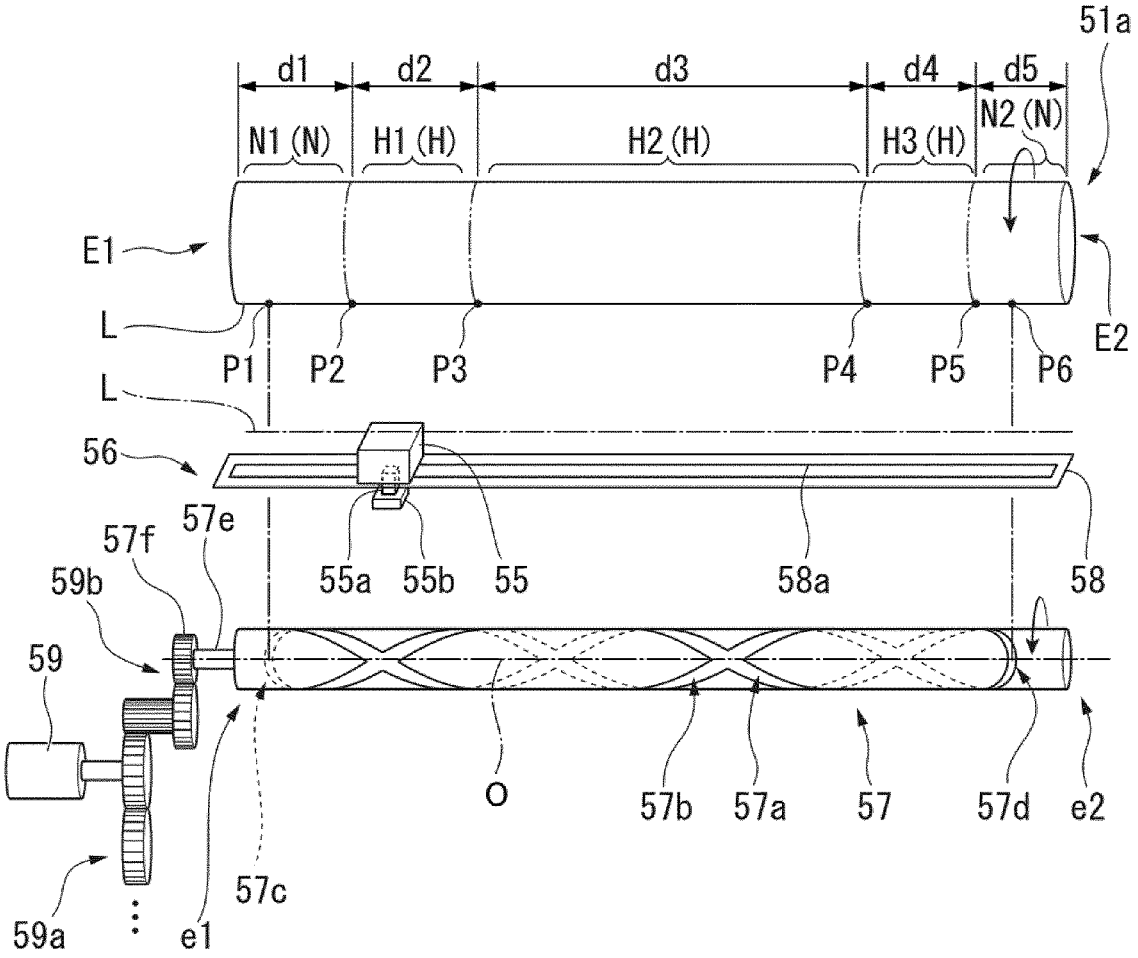
FIG. 3 is a schematic perspective view illustrating a configuration example of main portions.
Figure 4:
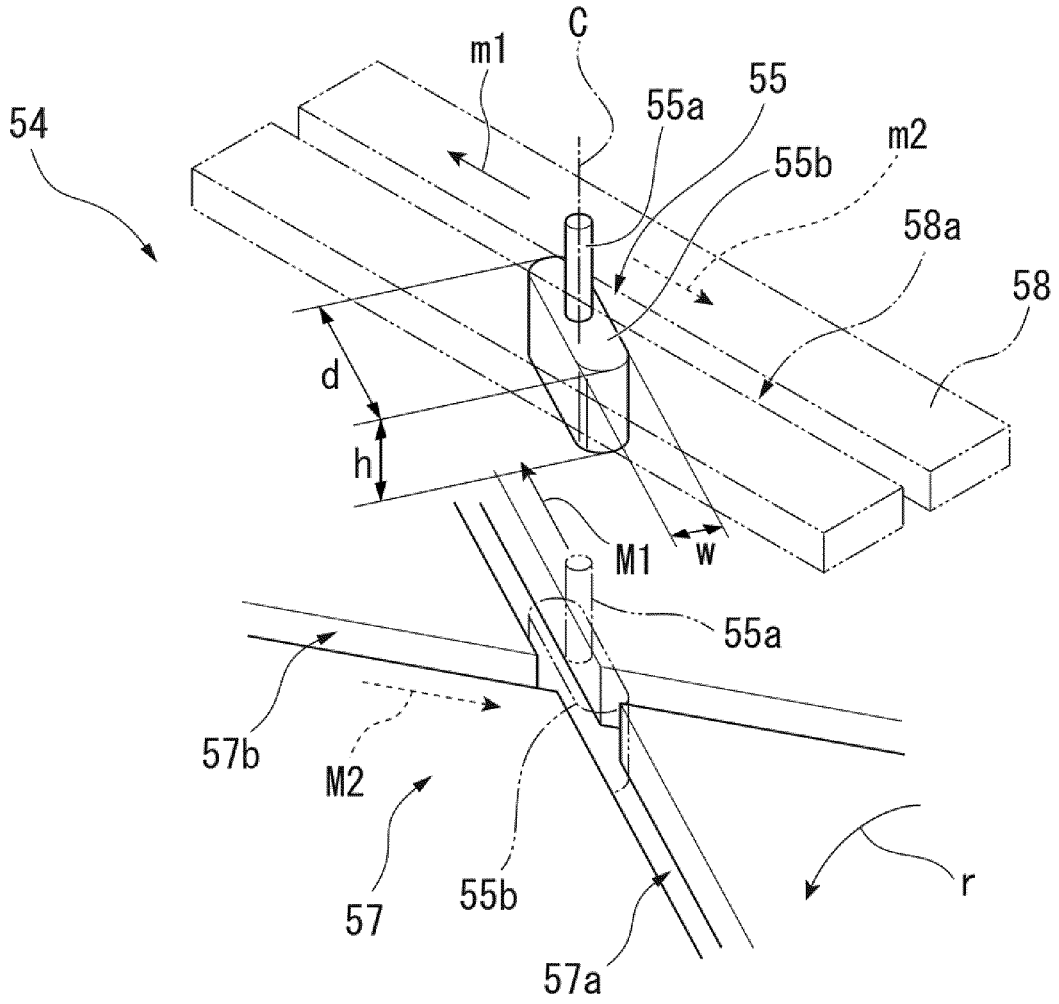
FIG. 4 is a schematic perspective view illustrating a configuration example of an engagement portion of a movement mechanism.

FIG. 3 is a schematic perspective view illustrating a configuration example of main portions of the fixing device of the first exemplary embodiment. FIG. 4 is a schematic perspective view illustrating a configuration example of an engagement portion of a movement mechanism of the fixing device of the first exemplary embodiment.

The fixing device 50 illustrated in FIG. 2 has a fixing belt induction heating type configuration as an example. The fixing member 51 of the fixing device 50 includes a fixing belt 51*a*, a pad 51*b*, a belt guide 51*c*, and an isolation guide 51*d*.

The fixing belt 51*a* is disposed to form the surface of the fixing member 51. The fixing belt 51*a* is a tubular endless belt. A belt width of the fixing belt 51*a* is larger than the maximum width of the sheet P which can pass. The fixing belt 51*a* is made of metal. For example, the fixing belt 51*a* may be made of a material such as stainless steel.

The fixing belt 51*a* is rotated counterclockwise in the drawing by receiving rotation drive force due to rotation of the pressing member 52.

A heating member 53 is disposed on an opposite side to the pressing member 52 on an outer circumference of the fixing belt 51*a*. In the example illustrated in FIG. 2, an IH heater is used as the heating member 53. The IH heater generates an eddy-current in the fixing belt 51*a* with alternating magnetic flux so as to heat the fixing belt 51*a*. The alternating magnetic flux of the IH heater is formed through flowing of an alternating current.

The IH heater used for the heating member 53 includes a plurality of IH coils which generate magnetic flux independently from each other. The plurality of IH coils are arranged in a longitudinal direction (orthogonal to the plane of the drawing) of the fixing belt 51*a*. The fixing belt 51*a* facing the IH coils is inductively heated during conduction of the IH coils. In the fixing belt 51*a*, a heated region which is inductively heated by the IH coils is formed at a location facing the IH coils in the fixing belt 51*a*.

The number and an arrangement pattern of the IH coils is not particularly limited. In the present exemplary embodiment, as illustrated in FIG. 3, in a width direction from a first end part E1 (rear end part) of the fixing belt 51*a* toward a second end part E2 (front end part), a first non-heated region N1 (non-heated region), a first heated region H1 (heated region), a second heated region H2 (heated region), a third heated region H3 (heated region), and a second non-heated region N2 (non-heated region) are formed in this order.

The first non-heated region N1 is a region which does not face the IH coils of the heating member 53 in the fixing belt 51*a*. The first non-heated region N1 is not inductively heated by magnetic flux of the IH coils. The first non-heated region N1 is formed in a range of a distance d1 from the first end part E1.

The first heated region H1 is formed in a range from the position of the distance d1 from the first end part E1 to a position of a distance d1+d2.

The second heated region H2 is formed in a range from the position of the distance d1+d2 from the first end part E1 to a position of a distance d1+d2+d3.

The third heated region H3 is formed in a range from the position of the distance d1+d2+d3 from the first end part E1 to a position of a distance d1+d2+d3+d4.

The second non-heated region N2 is a region which is not inductively heated by magnetic flux of the IH coils in the same manner as the first non-heated region N1. The second non-heated region N2 is formed in a range from the position of a distance d1+d2+d3+d4 from the first end part E1 to the second end part E2. A width of the second non-heated region N2 of the fixing belt 51*a* in the longitudinal direction is d5.

Here, a relationship of d1>d5, and d2=d4<d3 is established. The distance d2+d3+d4 is larger than the maximum width of the sheet P which can pass in the image forming system 100. The distance d3 is substantially the same as a width size of the sheet P which is highly frequently used in the image forming system 100. For example, the paper passing maximum width of the image forming system 100 may be a width size of 297 mm at A3 vertical feed (A4 horizontal feed). For example, the width d3 may be a width size of 210 mm at A4 vertical feed (A5 horizontal feed).

Here, the "horizontal feed" indicates that sheet P is carried such that the long side of sheet P extends at least in part in the first carrying orthogonal direction. The "vertical feed" indicates that sheet P is carried such that the long side of sheet P extends at least in part in the first carrying direction.

As illustrated in FIG. 2, the pad 51*b* is disposed inside the fixing belt 51*a*. The pad 51*b* opposes a fixing nip N with the fixing belt 51*a* interposed therebetween. The pad 51*b* is pressed toward the fixing belt 51*a* by a spring or the like (not illustrated). The pad 51*b* has the same length as a length of the fixing nip N. The pad 51*b* stabilizes a nip width of the fixing nip N.

A heat-resistive low-friction coat may be applied to a contact surface of the pad 51*b* with the fixing belt 51*a*.

The belt guide 51*c* is inserted into the inside of the fixing belt 51*a*. The belt guide 51*c* guides the fixing belt 51*a* to be rotated. The belt guide 51*c* maintains a shape of the fixing belt 51*a* to be a substantially cylindrical shape. As a material of the belt guide 51*c*, metals, ceramics, or the like of which a sliding characteristic with an inner circumference of the fixing belt 51*a* is favorable and which has heat resistance to a fixing temperature are used.

The isolation guide 51*d* guides the sheet P passed through the fixing nip N to be peeled off from the fixing belt 51*a*. The isolation guide 51*d* is disposed on an outer circumference of the fixing belt 51*a*. The isolation guide 51*d* is disposed on the downstream side of the fixing nip N in the rotation direction of the fixing belt 51*a*. A distal end part of the isolation guide 51*d* is in contact with the outer circumferential surface of the fixing belt 51*a*.

In the example illustrated in FIG. 2, the pressing member 52 is formed of an elasticroller. The pressing member 52 includes a core metal 52*a* and an elastic layer 52*b*.

The core metal 52*a* is a metallic tubular member. For example, the core metal 52*a* may be made of an aluminum alloy.

Both end parts of the core metal 52*a* is supported by a support member (not illustrated) of the fixing device 50 via a bearing (not illustrated). The core metal 52*a* is rotatable about a central axis line of the core metal 52*a*.

The elastic layer 52*b* is made of, for example, a heat-resistive rubber material. The elastic layer 52*b* may be made of, for example, a silicone rubber.

A release layer (not illustrated) is formed on an outer circumferential surface of the elastic layer 52*b*. The release layer is made of a resin material having favorable release property for toner. For example, the release layer may be made of fluororesin.

A gear (not illustrated) is provided at an end part (rear end part) of the core metal 52*a* in an axial direction. The gear transmits rotation drive force to the core metal 52*a*. The rotation drive force transmitted by the gear is generated by a drive motor 59 (refer to FIG. 3). The rotation drive force generated by the drive motor 59 is transmitted to the gear via a transmission mechanism 59*a* (refer to FIG. 3) connected to the drive motor 59.

The type of drive motor 59 is not particularly limited as long as a rotation speed can be changed. For example, a brush motor, a brushless motor, or a step motor may be used as the drive motor 59. A motor of which a rotation position of a rotation axis cannot be aligned may be used as the drive motor 59.

If the rotation drive force is transmitted to the gear connected to the core metal 52*a*, the pressing member 52 is rotated clockwise in FIG. 2 centering on a central axis line of the core metal 52*a*.

In the fixing device 50, a temperature measurement unit 54 is disposed on the outer circumference of the fixing member 51. The temperature measurement unit 54 faces the fixing belt 51*a* at a position on the downstream side of the heating member 53 and on the upstream side of the fixing nip N in the rotation direction of the fixing belt 51*a*. In the example illustrated in FIG. 2, the temperature measurement unit 54 faces the outer surface of the fixing belt 51*a* under the rotation center of the fixing belt 51*a*.

The temperature measurement unit 54 can measure the temperature of the fixing belt 51*a* after the fixing belt 51*a* is heated by the heating member 53 before the fixing belt 51*a* reaches the fixing nip N.

The temperature measurement unit 54 illustrated in FIG. 2 includes a temperature measurement sensor 55 and a movement mechanism 56.

The temperature measurement sensor 55 measures the temperature of the outer surface of the fixing belt 51*a* of the fixing member 51. For example, a thermistor or a thermopile may be used as the temperature measurement sensor 55.

The temperature measured by the temperature measurement sensor 55 is sent to a fixing controller 120 (described below) provided in the controller 110.

As illustrated in an exploded perspective view of FIG. 3, the temperature measurement sensor 55 includes a guide pin 55*a* (follower) and a slide shoe 55*b* (an engagement portion of the follower).

The guide pin 55*a* protrudes downward of the temperature measurement sensor 55.

As illustrated in FIG. 4, a shape of the slide shoe 55*b* in a plan view is an elliptical shape of which a major axis and a minor axis are respectively d and w (where d>w). A height of the slide shoe 55*b* is h. A distal end part of the guide pin 55*a* in the major axis direction is rounded.

The slide shoe 55*b* is fixed to be rotatable about a central axis line C of the guide pin 55*a*.

As illustrated in FIG. 3, the movement mechanism 56 moves the temperature measurement sensor 55 on a scanning line L which extends at least in part in the width direction of the fixing belt 51*a*. The temperature measurement sensor 55 scans a region of the outer surface of the fixing belt 51*a* along the scanning line L as a result of being moved by the movement mechanism 56.

In the present exemplary embodiment, the movement mechanism 56 repeatedly and reciprocally moves the temperature measurement sensor 55 on the scanning line L. A range in which the temperature measurement sensor 55 is moved by the movement mechanism 56 is from a point P1 near the first end part E1 to a point P6 near the second end part E2. The points P1 and P6 are return positions in movement performed by the movement mechanism 56.

Points P2, P3, P4 and P5 between the points P1 and P6 are respectively a boundary point between the first non-heated region N1 and the first heated region H1, a boundary point between the first heated region H1 and the second heated region H2, a boundary point between the second heated region H2 and the third heated region H3, and a boundary point between the third heated region H3 and the second non-heated region N2.

In the present exemplary embodiment, a distance between the point P1 and the point P2 is longer than a distance between the point P6 and the point P5.

A specific configuration of the movement mechanism 56 is not particularly limited as long as the above-described arrangement and movement operation are possible.

In the example illustrated in FIG. 3, the movement mechanism 56 includes a cylindrical cam 57 (cam mechanism) and a slide guide 58 (a cam mechanism or a linear guide).

The cylindrical cam 57 has a columnar shape extending a central axis line O. A length of the cylindrical cam 57 is larger than a length of a scanning range of the movement mechanism 56. As illustrated in FIG. 2, the cylindrical cam 57 opposes the fixing member 51 with the temperature measurement sensor 55 and the slide guide 58 interposed therebetween.

As illustrated in FIG. 3, the central axis line O of the cylindrical cam 57 is parallel to the scanning line L. Hereinafter, an end part of the cylindrical cam 57 opposing the first end part E1 of the fixing member 51 will be referred to as a first end part e1. An end part of the cylindrical cam 57 opposing the second end part E2 of the fixing member 51 will be referred to as a second end part e2.

A rotation shaft 57*e* extends at least in part to the first end part e1 of the cylindrical cam 57 on the same axis as the central axis line O. The rotation shaft 57*e* is rotatably supported at a case (not illustrated) of the temperature measurement unit 54. A tip end part of the rotation shaft 57*e* is connected to a gear 57*f*.

The gear 57*f* is connected to the drive motor 59 via a transmission mechanism 59*b*.

In the cylindrical cam 57, the rotation drive force of the drive motor 59 is transmitted to the gear 57*f* via the transmission mechanism 59*b*. The cylindrical cam 57 is driven to be rotated about the central axis line O by the drive motor 59.

A rotation direction and a rotation speed of the cylindrical cam 57 are not particularly limited. However, the drive motor 59 also rotatably drives the pressing member 52. Thus, a rotation speed of the cylindrical cam 57 has a predefined ratio with rotation speeds of the pressing member 52 and the fixing member 51 interlocked therewith. A rotation speed of the cylindrical cam 57 may be determined according to a speed required for movement of the temperature measurement sensor 55, which will be described later.

Hereinafter, as an example, a description will be made assuming that, when viewed in a direction from the first end part e1 toward the second end part e2 along the central axis line O, a rotation direction of the cylindrical cam 57 is a clockwise direction.

A first spiral groove 57*a* and a second spiral groove 57*b*, which are cam grooves, are formed on the surface of the cylindrical cam 57.

When viewed in the direction from the first end part e1 toward the second end part e2 along the central axis line O, the first spiral groove 57*a* revolves counterclockwise from the first end part e1 toward the second end part e2. Similarly, the second spiral groove 57*b* revolves clockwise. Groove widths of the first spiral groove 57*a* and the second spiral groove 57*b* are the same as each other.

The first spiral groove 57*a* and the second spiral groove 57*b* intersect each other in an X shape at one or more locations. In FIG. 3, as an example, the first spiral groove 57*a* and the second spiral groove 57*b* intersect each other at four locations.

Each of the groove widths of the first spiral groove 57*a* and the second spiral groove 57*b* is larger than the minor axis w of the slide shoe 55*b* and is smaller than the major axis d thereof. An opening width at the intersection between the first spiral groove 57*a* and the second spiral groove 57*b* is smaller than the major axis d of the slide shoe 55*b*.

End parts of the first spiral groove 57*a* and the second spiral groove 57*b* on the first end part e1 side are smoothly connected to each other at a first connection part 57*c*. Similarly, end parts of the first spiral groove 57*a* and the second spiral groove 57*b* on the second end part e2 side are smoothly connected to each other at a second connection part 57*d*. The first connection part 57*c* opposes the point P1. The second connection part 57*d* opposes the point P6.

The first spiral groove 57*a* and the second spiral groove 57*b* return at both end parts in the axial direction of the cylindrical cam 57 so as to form a continuous loop.

The slide guide 58 guides the temperature measurement sensor 55 to be linearly moved. For example, the slide guide 58 is a tabular member extending in the width direction of the fixing member 51. In the slide guide 58, a guide hole 58*a* which extend parts in parallel to the scanning line L penetrates through the slide guide 58 in a plate thickness direction. A length of the guide hole 58*a* is larger than the length from the point P1 to the point P6. The guide pin 55*a* is slidably fitted to the guide hole 58*a* in a longitudinal direction of the guide hole 58*a*.

Although not illustrated, the slide guide 58 is provided with a rotation stop mechanism which restricts rotational movement of the guide pin 55*a* about the central axis line C during movement of the temperature measurement sensor 55.

As illustrated in FIG. 4, in the temperature measurement unit 54, the slide shoe 55*b* is assembled to be inserted into the first spiral groove 57*a* or the second spiral groove 57*b* (refer to a two-dot chain line in the drawing). The slide shoe 55*b* is slidable in the first spiral groove 57*a* or the second spiral groove 57*b* along the major axis direction of the slide shoe 55*b*.

For example, if the slide shoe 55*b* is fitted to the first spiral groove 57*a*, the cylindrical cam 57 is rotated in a direction of an arrow r, and thus the slide shoe 55*b* is relatively moved in a direction of a solid arrow M1 with respect to the cylindrical cam 57. The major axis of the slide shoe 55*b* is longer than the groove widths of the first spiral groove 57*a* and the second spiral groove 57*b*. Thus, the slide shoe 55*b* can smoothly advance through the intersection between the first spiral groove 57*a* and the second spiral groove 57*b* in the major axis direction.

On the other hand, a movement direction of the guide pin 55*a* is restricted to the longitudinal direction of the guide hole 58*a* by the guide hole 58*a*. Thus, the guide pin 55*a* and the temperature measurement sensor 55 (not illustrated) connected thereto are moved in a direction of a solid arrow m1.

In contrast, if the slide shoe 55*b* is fitted to the second spiral groove 57*b*, the second spiral groove 57*b* is relatively moved in a direction of a dashed arrow M2 with respect to the cylindrical cam 57. Thus, the guide pin 55*a* and the temperature measurement sensor 55 (not illustrated) connected thereto are moved in a direction of a dashed arrow m2.

As mentioned above, according to the movement mechanism 56, an advancing direction of the temperature measurement sensor 55 is changed depending on whether the slide shoe 55*b* is fitted to the first spiral groove 57*a* or the second spiral groove 57*b*. The temperature measurement sensor 55 is reciprocally moved between the point P1 and the point P6 on the scanning line L due to continuous rotation of the cylindrical cam 57 in the direction of the arrow M.

Here, a description will be made of a relationship between the above-described constituent elements of the fixing device 50 and the controller 110.

Figure 5:
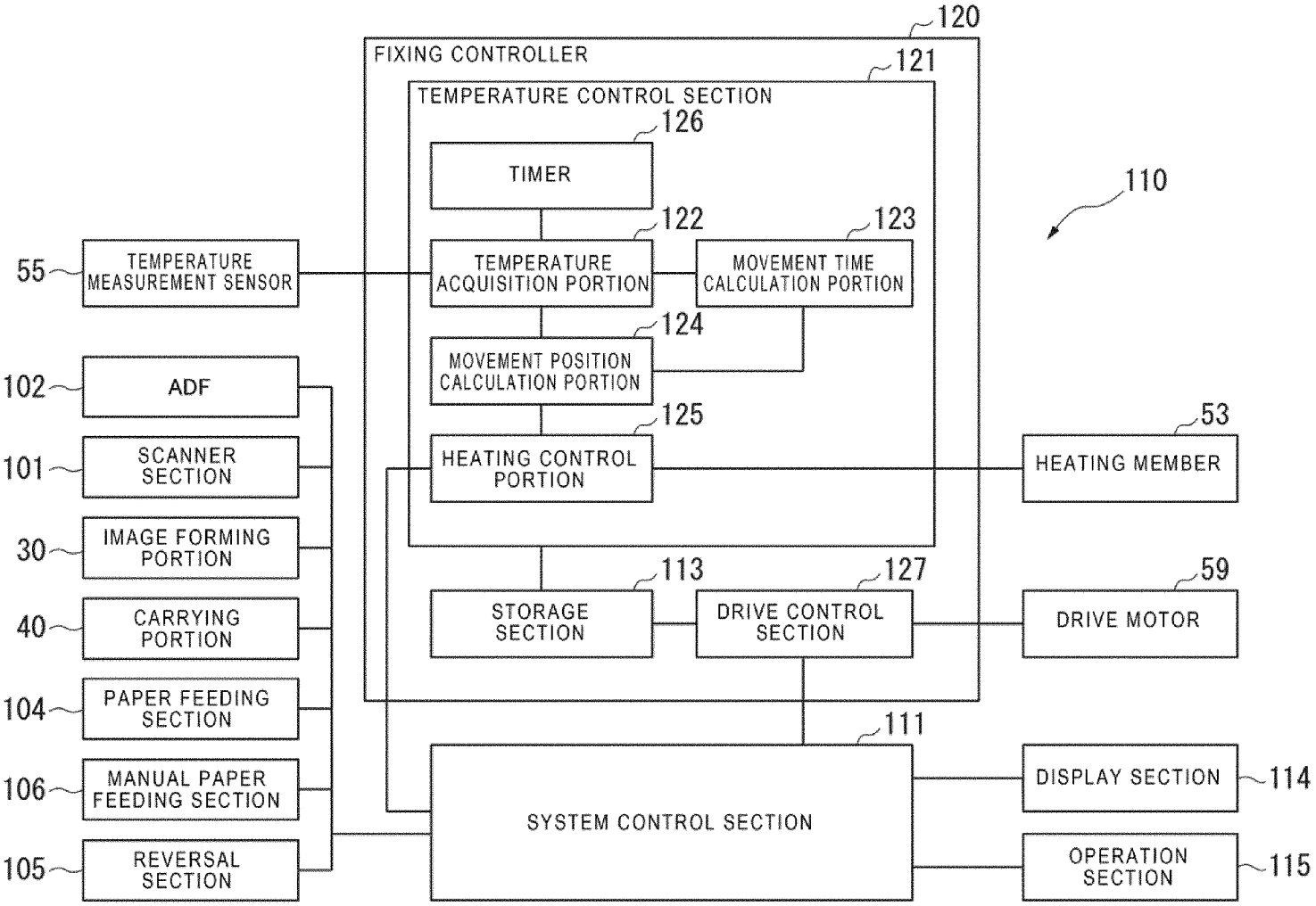
FIG. 5 is a block diagram illustrating a control system.

FIG. 5 is a block diagram of a control system of the fixing device of the first exemplary embodiment.

As illustrated in FIG. 5, the controller 110 includes a system control section 111 and a fixing controller 120.

The system control section 111 controls the entire operation of the image forming system 100. The system control section 111 is communicably connected to a display section 114, an operation section 115, the ADF 102, the scanner section 101, the image forming portion 30, the carrying portion 40, the fixing controller 120 (described below), and a storage section 113.

The system control section 111 controls an operation of the image forming system 100 on the basis of an input operation from the operation section 115 or a control signal from an external apparatus (not illustrated) connected thereto via a communication line.

The fixing controller 120 includes a temperature control section 121, a drive control section 127, and the storage section 113. The fixing controller 120 is communicably connected to the system control section 111, the temperature measurement sensor 55, the heating member 53, and the drive motor 59. The fixing controller 120 controls an operation of the fixing device 50 on the basis of a control signal from the system control section 111.

The fixing controller 120 is formed of a combination of the CPU and the fixing control circuit of the controller 110.

The temperature control section 121 includes a timer 126, a temperature acquisition portion 122, a movement time calculation portion 123, a movement position calculation portion 124, and a heating control portion 125.

The timer 126 measures time t.

The temperature acquisition portion 122 is communicably connected to the temperature measurement sensor 55 and the timer 126. The temperature acquisition portion 122 acquires temperature information measured by the temperature measurement sensor 55. The temperature acquisition portion 122 acquires the time t at which the temperature information is acquired from the timer 126.

The temperature information and the time t acquired by the temperature acquisition portion 122 are sent to the movement time calculation portion 123 and the movement position calculation portion 124 as T(t). T(t) is stored in the storage section 113.

The movement time calculation portion 123 obtains arrival time to the first end part E1 and the second end part E2 in the scanning range of the movement mechanism 56 on the basis of a temperature change measured by the temperature measurement sensor 55 due to movement of the temperature measurement sensor 55. The movement time calculation portion 123 calculates a movement time ts (first movement time) for which the temperature measurement sensor 55 is moved between the first end part E1 and the second end part E2. The movement time calculation portion 123 calculates a time t (second movement time) for which the temperature measurement sensor 55 is moved from the first end part E1 or the second end part E2 to a movement position thereof.

The movement position calculation portion 124 calculates the movement position of the temperature measurement sensor 55 on the basis of a ratio of the time t to the movement time ts.

The heating control portion 125 is communicably connected to the system control section 111, the movement position calculation portion 124, and the heating member 53.

The heating control portion 125 controls starting or ending of heating of the fixing member 51 on the basis of a control signal from the system control section 111. The heating control portion 125 controls output from the heating member 53 such that a temperature distribution of the fixing member 51 on the scanning line L is included in a predefined allowable range.

For example, if a control signal for changing a fixing temperature is received from the system control section 111, the heating control portion 125 changes a target temperature of the fixing member 51 to a predefined temperature in response to the control signal from the system control section 111.

The drive control section 127 is communicably connected to the system control section 111 and the drive motor 59. The drive control section 127 drives the drive motor 59 on the basis of a control signal from the system control section 111.

For example, if a control signal for changing a linear velocity of the pressing member 52 is received from the system control section 111, the drive control section 127 changes a linear velocity of the drive motor 59 so as to drive the drive motor 59. Such linear velocity changing is performed, for example, if a thick paper mode is set in which a thick paper passes as the sheet P.

The storage section 113 stores control data for the fixing controller 120 to perform control. The storage section 113 is formed of a ROM, a RAM, and other storage media.

A more detailed control operation of the fixing controller 120 will be described later along with a description of an operation of the image forming system 100.

Next, an operation of the image forming system 100 will be described focusing on an operation of the fixing device 50.

Figure 6:
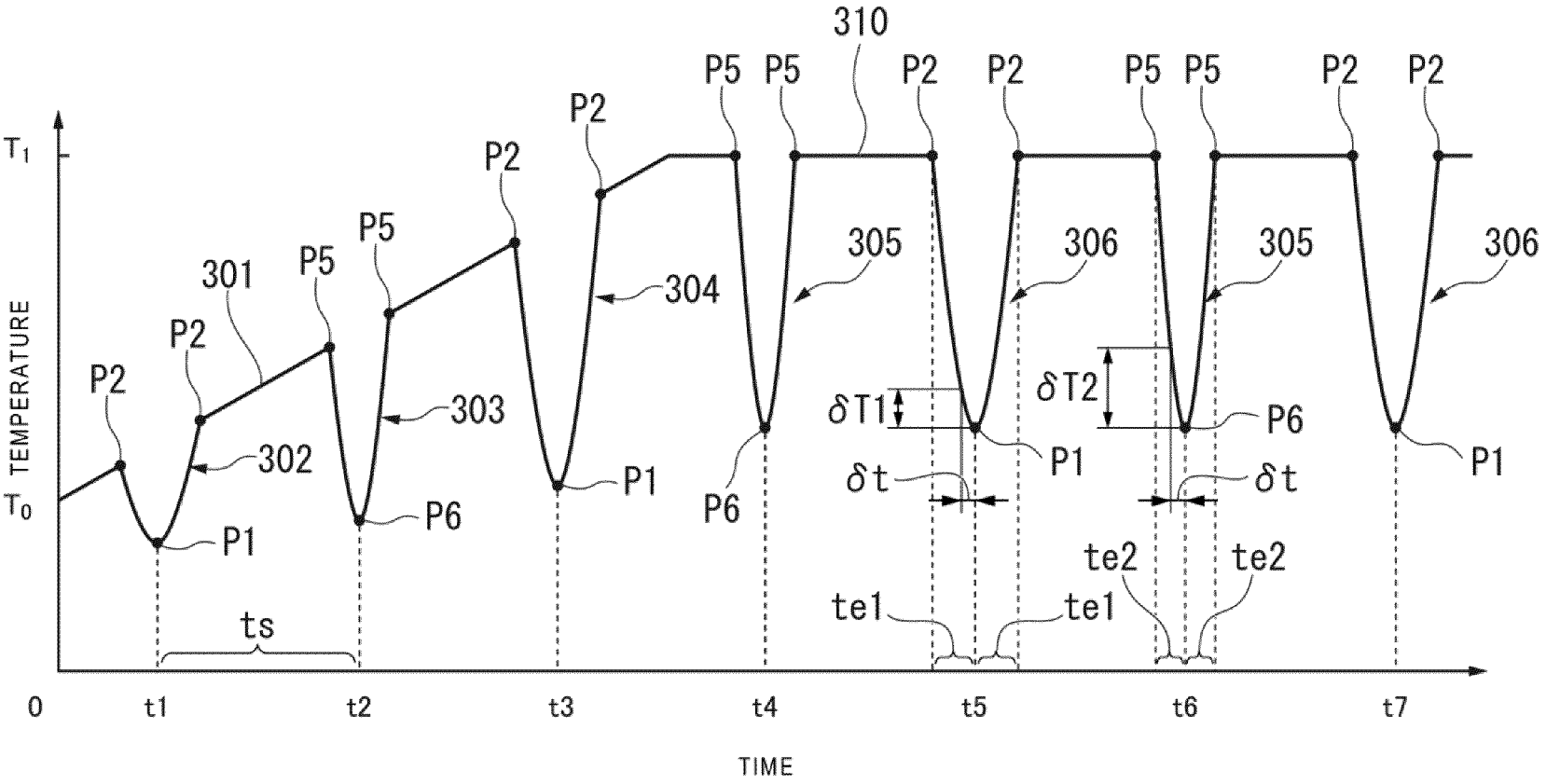
FIG. 6 is a graph illustrating an output example of a temperature measurement sensor.
Figure 7:
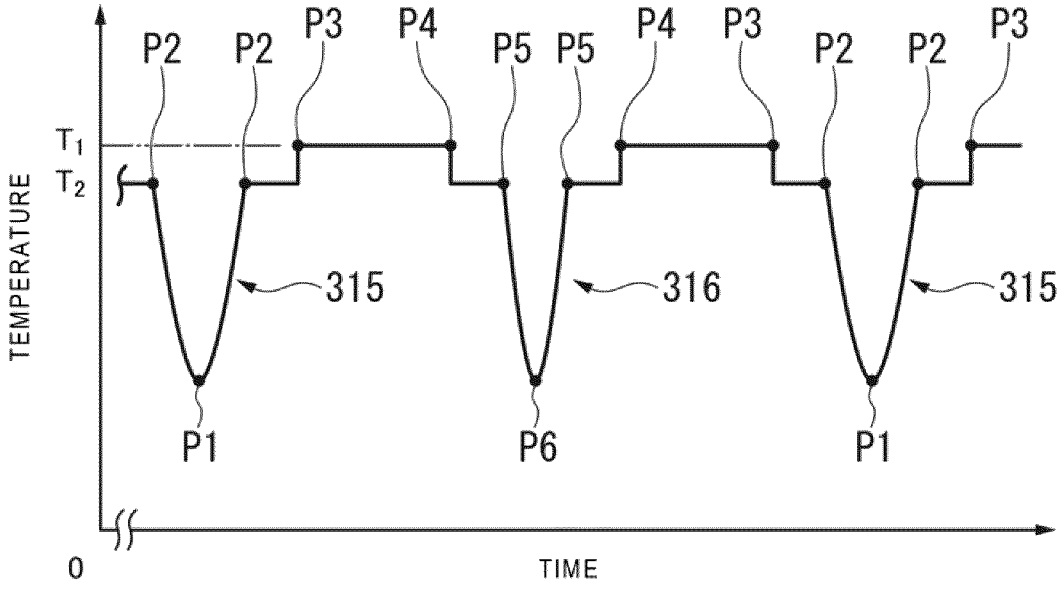
FIG. 7 is a graph illustrating a temperature distribution example in a steady state of a fixing member.
Figure 8:
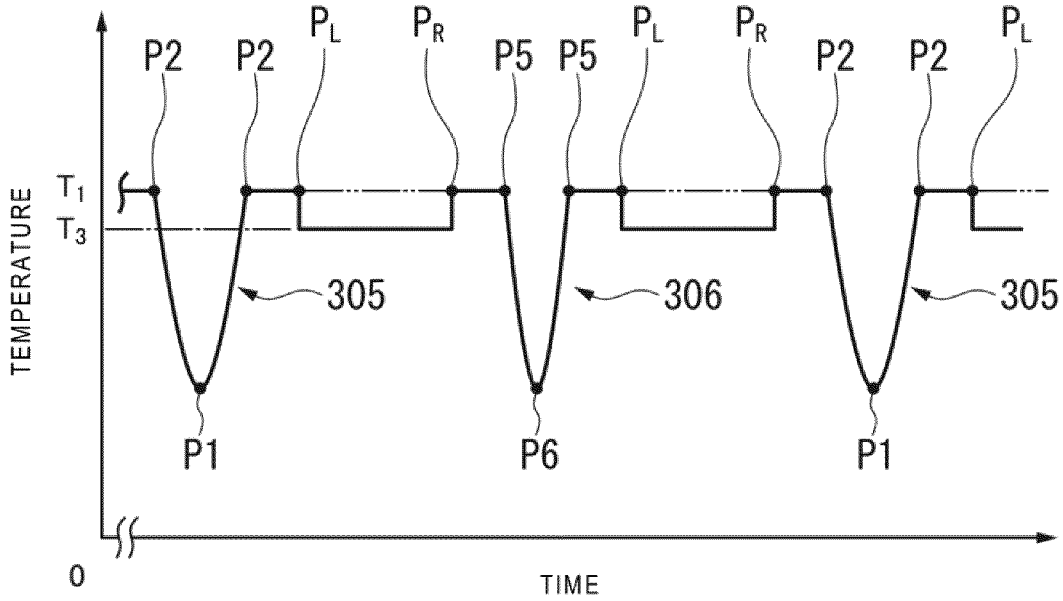
FIG. 8 is a graph illustrating a temperature distribution example in a steady state of a fixing member.

FIG. 6 is a graph illustrating an output example of the temperature measurement sensor of the fixing device of the first exemplary embodiment. FIGS. 7 and 8 are graphs illustrating temperature distribution examples in a steady state of the fixing member of the fixing device of the first exemplary embodiment. In FIGS. 6 to 8, a transverse (x-) axis expresses time, and a longitudinal (y-) axis expresses the temperature of the fixing belt 51*a*.

The image forming system 100 of the present exemplary embodiment illustrated in FIG. 1 performs an image formation on the sheet P in response to an operator's operation on the operation section or an operation command from an external apparatus connected to the image forming system 100.

If the sheet P is carried from the paper feeding section 104 or the manual paper feeding section 106, a toner image is formed on the sheet P according to known electrophotographic processes performed by the image forming portion 30. The toner image on the sheet P is fixed to the sheet P by the fixing device 50. The sheet P to which the toner image is fixed is discharged to the paper discharge table 103*a* by the paper discharge roller 60, or is carried by the reversal section 105 so as to be brought into duplex printing.

The fixing device 50 controls the temperature of the fixing member 51 until the sheet P enters the fixing nip N. Through the temperature control, a temperature distribution of the fixing member 51 becomes a predefined distribution according to a size of the sheet P or a fixing mode for the sheet P.

If fixing temperature control is started in response to a control signal from the system control section 111, the fixing controller 120 causes the drive control section 127 to start driving of the drive motor 59. The fixing controller 120 causes the heating control portion 125 to start heating in the heating member 53.

If the drive motor 59 is driven, the pressing member 52 is rotated, and thus the fixing belt 51*a* is rotated. The cylindrical cam 57 of the temperature measurement unit 54 is rotated about the central axis line O. The cylindrical cam 57 is rotated, and thus the temperature measurement sensor 55 reciprocally performs scanning on the scanning line L. A scanning speed of the temperature measurement sensor 55 is constant if a rotation speed of the cylindrical cam 57 is constant. The temperature measurement sensor 55 sequentially sends information regarding measured temperatures to the fixing controller 120.

The temperature acquisition portion 122 of the fixing controller 120 acquires the temperature information in the temperature measurement sensor 55. The temperature acquisition portion 122 acquires the temperature information at a preset appropriate sampling interval.

FIG. 6 is a graph illustrating an example of a temperature change in the fixing belt 51*a* based on temperature information acquired by the temperature acquisition portion 122. The origin of the time axis corresponds to a drive start time of the drive motor 59. A temperature $T_1$ is a target fixing temperature of the fixing belt 51*a*. FIG. 6 illustrates an example of a case where target fixing temperatures of the first heated region H1, the second heated region H2, and the third heated region H3 are the same as each other. Hereinafter, if the first heated region H1, the second heated region H2, and the third heated region H3 are collectively described, or are not differentiated from each other, the regions will be simply referred to as a "heated region H" in some cases. Similarly, if the first non-heated region N1 and the second non-heated region N2 are not differentiated from each other, the regions will be simply referred to as a "non-heated region N".

As heating in the heating member 53 progresses, the temperature of the fixing belt 51*a* increases from the initial temperature $T_0$ toward the temperature $T_1$ as indicated by a curve 301. However, the non-heated region N of the fixing belt 51*a* is not heated by the heating member 53. A U-shaped temperature reduction part 302 or the like appears on the graph.

However, the temperature of the non-heated region N gradually increases due to heat conduction from the adjacent heated region H. Thus, for example, as illustrated in the temperature reduction parts 302, 303 and 304, the minimum value of each temperature reduction part increases with the passage of time. If the temperature of the heated region H becomes the temperature $T_1$ (refer to a curve 310), the minimum value of each temperature reduction part is stabilized as illustrated in temperature reduction parts 305 and 306.

In the present exemplary embodiment, the minimum value of a temperature in each temperature reduction part on the graph indicates a temperature at the point P1 or the point P6. A bent point at an upper end part of each temperature reduction part corresponds to a temperature at the point P2 or the point P5.

In the present exemplary embodiment, a distance between the point P1 and the point P2 is longer than a distance between the point P6 and the point P5 on the scanning line L, and thus a time te1 required for movement on a path P2P1 or a path P1P2 is longer than a time te2 required for movement on a path P5P6 or a path P6P5.

Thus, on the graph, a width of each of the temperature reduction parts 303 and 305 passing through the point P2 is smaller than a width of each of the temperature reduction parts 302, 304 and 306 passing through the point P1.

In the present exemplary embodiment, a return position passing time to pass through the point P1 or the point P6 is obtained by using such characteristics. Whether a passage point is the point P1 or the point P6 is determined. A detailed operation example will be described later.

In the example of another temperature distribution in a steady state of the fixing member 51 illustrated in FIG. 7, a temperature in the second heated region H2 is controlled to be a temperature $T_1$, and temperatures in the first heated region H1 and the third heated region H3 are controlled to be a temperature $T_2$ (where $T_2<T_1$). This temperature control may be performed, for example, if a width size of the sheet P is small.

The temperature $T_2$ is set to be much higher than a temperature in the non-heated region N. This is because, if the first heated region H1 and the third heated region H3 stops being heated, temperature unevenness tend parts to occur in the heated region H when switching to passage of the sheet P with a large width size occurs.

Thus, the substantially same temperature reduction parts 315 and 316 as the temperature reduction parts 305 and 306 in FIG. 6 appear in a graph which is equal to or lower than the temperature $T_2$.

An example of still another temperature distribution in a steady state of the fixing member 51 illustrated in FIG. 8 indicates a fixing temperature reduction due to continuous passage of the sheet P with a small size.

In this case, a target fixing temperature in each heated region H is $T_1$ in the same manner as in FIG. 6. However, the sheets P with a width size smaller than the entire width of the heated region H continuously pass, and thus the temperature of the passing sheet surface is reduced to $T_3$ (where $T_3<T_1$). Points $P_L$ and $P_R$ respectively correspond to positions of both end parts (left, L, and right, R) of the sheet P in the width direction.

In this case, temperature control using the heating member 53 is continuously performed, and the temperature $T_1$ is not considerably reduced to the temperature $T_3$. Thus, the same temperature reduction parts 305 and 306 as in FIG. 6 appear on the graph.

As described above, in the fixing device 50, even if a target fixing temperature is changed, and unevenness occurs in a temperature distribution due to a reduction in temperature control performance, it can be seen that the temperature measurement sensor 55 detects a considerable temperature reduction part when passing through the non-heated region N.

Next, a description will be made of an example of a fixing temperature control method of the present exemplary embodiment performed by using such characteristics.

Figure 9:
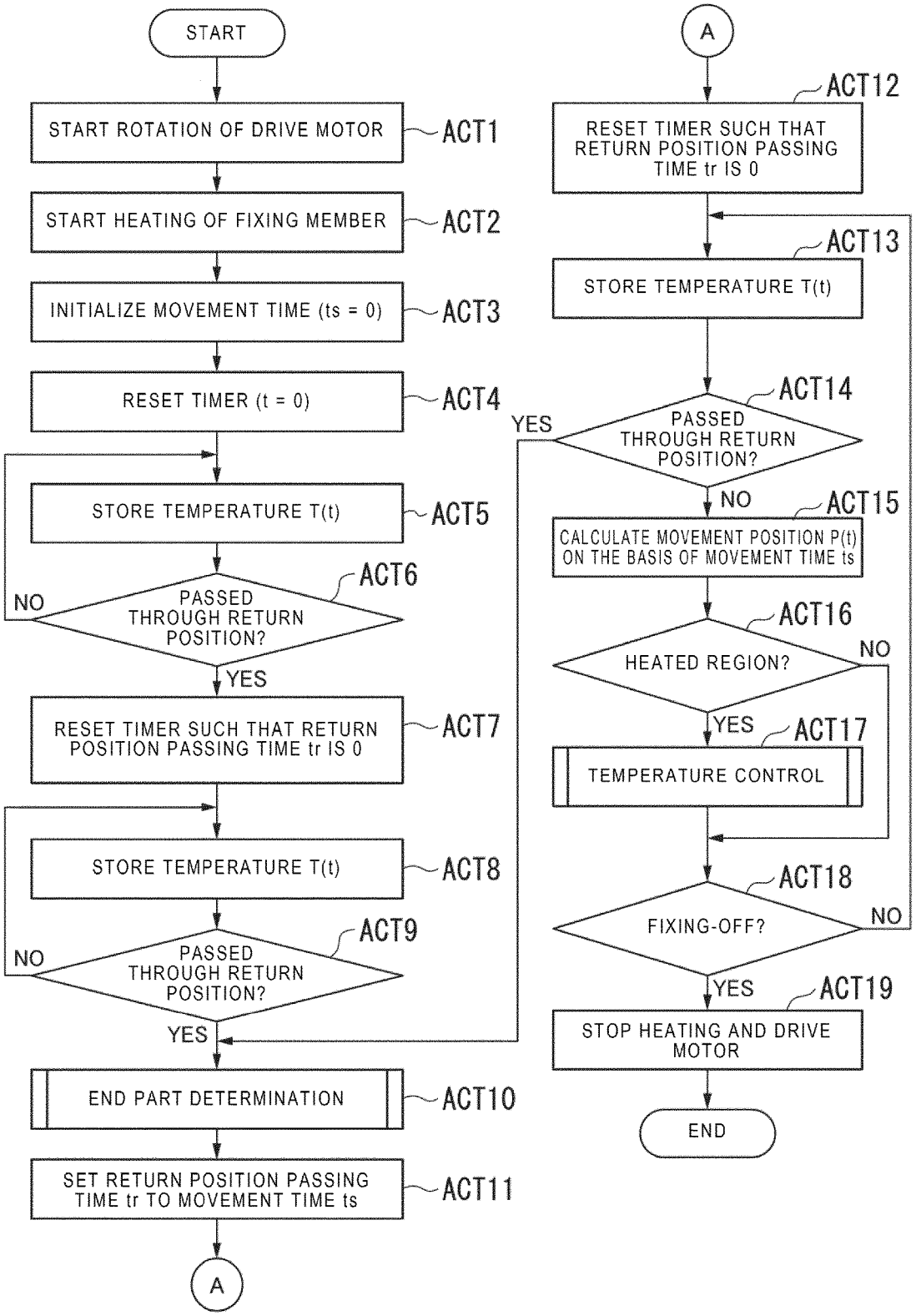
FIG. 9 is a flowchart illustrating an example of a fixing temperature control method.
Figure 10:
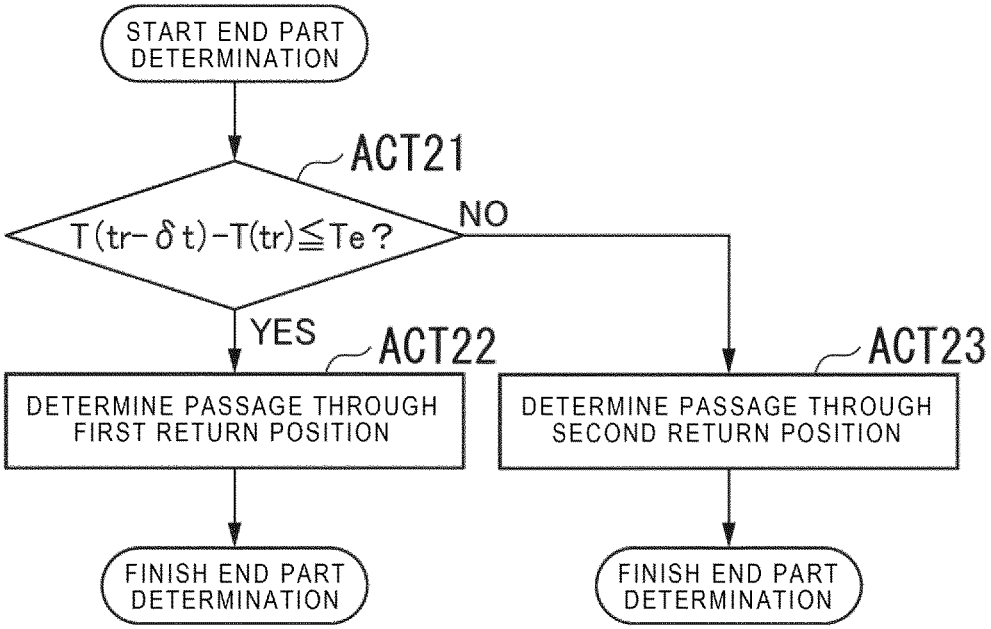
FIG. 10 is a flowchart illustrating an example of an end part determination in the fixing temperature control method.
Figure 11:
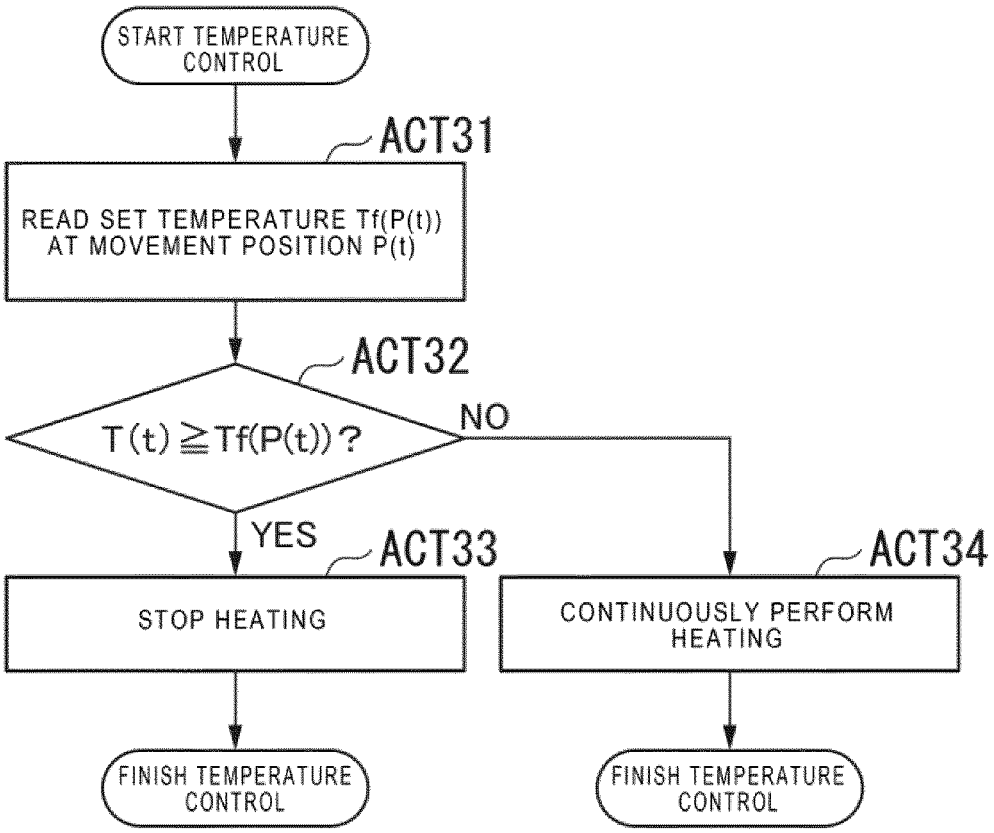
FIG. 11 is a flowchart illustrating an example of temperature control.

FIG. 9 is a flowchart illustrating an example of a fixing temperature control method of the first exemplary embodiment. FIG. 10 is a flowchart illustrating an example of an end part determination in the fixing temperature control method of the first exemplary embodiment. FIG. 11 is a flowchart illustrating an example of temperature control in the fixing temperature control method of the first exemplary embodiment.

In an example of the fixing temperature control method of the present exemplary embodiment, ACT 1 to ACT 18 in the flowchart of FIG. 9 are performed according to the flow in FIG. 9.

In ACT 1, the drive motor 59 starts to be rotated.

As described above, if fixing temperature control is started in response to a control signal from the system control section 111, the fixing controller 120 causes the drive control section 127 to start driving of the drive motor 59.

After ACT 1, ACT 2 is performed. In ACT 2, the fixing member 51 starts to be heated.

Specifically, the fixing controller 120 causes the heating control portion 125 to start heating in the heating member 53. Hereinafter, for simplification, a description will be made of an example of a case where a target fixing temperature in each heated region H is $T_1$.

After ACT 2, ACT 3 is performed. In ACT 3, the movement time ts is initialized.

Specifically, the temperature control section 121 sets a variable ts (hereinafter, referred to as "movement time ts") indicating movement time to ts=0.

After ACT 3, ACT 4 is performed. In ACT 4, the timer 126 is reset.

Specifically, the temperature control section 121 resets time t to be measured by the internal timer 126 to 0.

After ACT 4, ACT 5 is performed. In ACT 5, the temperature T(t) is stored.

Specifically, the temperature control section 121 causes the temperature acquisition portion 122 to acquire the temperature information measured by the temperature measurement sensor 55 from the temperature measurement sensor 55. The temperature acquisition portion 122 acquires the temperature information from the temperature measurement sensor 55. The temperature acquisition portion 122 acquires the time t from the timer 126. The temperature acquisition portion 122 sends at least in part the time t and the temperature T(t) at the time t to the movement time calculation portion 123 and the movement position calculation portion 124. The temperature acquisition portion 122 stores the time t and the temperature T(t) in the storage section 113.

As mentioned above, ACT 5 is completed.

After ACT 5, ACT 6 is performed. In ACT 6, whether or not the temperature measurement sensor 55 passed through the return position is determined.

Specifically, the movement time calculation portion 123 determines whether or not the temperature measurement sensor 55 passed through the return position on the basis of a change in the temperature T(t) sent from the temperature acquisition portion 122. Here, the return position includes two points such as the point P1 and the point P6. In either case, the point is a position taking the minimum value of the temperature reduction part on the graph of the temperature T(t).

A return position passage determination method is not particularly limited as long as whether or not the minimum value is exceeded can be determined.

In the present exemplary embodiment, the following determination is performed as an example.

The movement time calculation portion 123 holds the highest temperature $T_p$ ($t_p$) through peak holding of the sequentially sent temperature T(t). If a temperature reduction value from $T_p(t_p)$ of the latest temperature T(t) exceeds a first threshold value $\Delta T_1$, the movement time calculation portion 123 determines that the temperature T(t) enters the temperature reduction part on the graph. Next, the movement time calculation portion 123 holds the lowest temperature $T_B(t_B)$ through bottom holding of the sequentially sent temperature T(t).

If a temperature increase value from the $T_B(t_B)$ of the latest temperature T(t) exceeds a second threshold value $\Delta T_2$, the movement time calculation portion 123 determines that the temperature T(t) exceeds the minimum value.

Here, the first threshold value $\Delta T_1$ is set to a value greater than a temperature reduction value which can be generated through temperature control in the heated region H, for example, $|T_1-T_2|$ in FIG. 7. The second threshold value $\Delta T_2$ is set to a value great enough not to detect measurement noise.

For example, the movement time calculation portion 123 estimates the lowest temperature $T_B(t_B)$ obtained through bottom holding as the minimum value of the temperature reduction part. The movement time calculation portion 123 stores a time $t_B$ at which the lowest temperature $T_B(t_B)$ is obtained in the storage section 113 as a return position passing time tr.

However, in a case where a sampling time is long, in order to detect a return position with higher accuracy, data sequence of the temperature T(t) near the lowest temperature $T_B(t_B)$ may be interpolated as appropriate. In this case, the minimum value of the temperature reduction part and the return position passing time tr having the minimum value are estimated on the basis of the minimum value of an interpolated curve.

If it is determined that the temperature measurement sensor 55 passed through the return position (ACT 6: YES), ACT 7 is performed.

If it is determined that the temperature measurement sensor 55 did not pass through the return position (ACT 6: NO), ACT 5 is performed.

After ACT 6 is completed, ACT 7 is performed. In ACT 7, the timer 126 is reset. The timer 126 is reset such that the return position passing time tr is 0.

If ACT6 is completed, the movement time calculation portion 123 calculates the last return position passing time tr. The movement time calculation portion 123 calculates a difference between the current time t and the last return position passing time tr. The movement time calculation portion 123 resets the timer 126 to be t=t−tr.

As mentioned above, ACT 7 is completed.

After ACT7, ACT8 is performed. In ACT8, the same operation as in ACT 5 is performed.

After ACT8, ACT 9 is performed. In ACT 9, the same operation as in ACT 6 is performed.

However, in ACT 9, if that the temperature measurement sensor 55 passed through the return position (ACT 9: YES), ACT 10 is performed. If that the temperature measurement sensor 55 did not pass through the return position is determined (ACT 9: NO), ACT 8 is performed.

After ACT 9 is completed, ACT 10 is performed. In ACT 10, whether the return position through which the temperature measurement sensor 55 passed at the last return position passing time tr is the point P1 or the point P6 is determined (hereinafter, referred to as an end part determination). Hereinafter, the point P1 on the first end part E1 side will be referred to as a first return position, and the point P6 on the second end part E2 side will be referred to as a second return position.

In the end part determination, an appropriate algorithm using a difference between the times te1 and te2 or the like in the above-described temperature reduction part may be used.

In the present exemplary embodiment, as an example, ACT 21 to ACT 23 are performed according to a flow in FIG. 10.

In ACT 21, the movement time calculation portion 123 determines whether or not a difference between the temperature T(tr) at the last return position passing time tr and a temperature T(tr−δt) at a time tr−δt which goes back by a predefined time δt (where 0<δt<te1, and 0<δt<te2) therefrom is equal to or less than a determination threshold value Te. The movement time calculation portion 123 calculates δT=T(tr−δt)−T(tr).

As illustrated in FIG. 6, for example, if the temperature measurement sensor 55 passed through the first return position at a time t5, δT=δT1 is obtained. In contrast, if the temperature measurement sensor 55 passed through the second return position at a time t6, δT=δT2 is obtained. In this case, since δT1<δT2, if the determination threshold value Te is set to a value of δT1≤Te<δT2 in advance, whether the return position is the first return position or the second return position can be determined. This is also the same for an end part determination for other return positions in FIG. 6.

If δT≤Te (ACT 21: YES), ACT 22 is performed.

If δT>Te (ACT 21: NO), ACT 23 is performed.

In ACT 22, the movement time calculation portion 123 determines that the temperature measurement sensor 55 passed through the first return position at the last return position passing time tr. The determination result is sent to the movement position calculation portion 124.

As mentioned above, the end part determination is finished. After ACT 22, ACT 11 is performed as in FIG. 9.

In ACT 23, the movement time calculation portion 123 determines that the temperature measurement sensor 55 passed through the second return position at the last return position passing time tr. The determination result is sent to the movement position calculation portion 124.

As mentioned above, the end part determination is finished. After ACT 23, ACT 11 is performed as in FIG. 9.

In ACT 11 illustrated in FIG. 9, the last return position passing time tr is set to the movement time ts.

Specifically, the movement time calculation portion 123 stores the last return position passing time tr in a storage location of the movement time ts between the return positions in the storage section 113.

In the above-described way, after the temperature measurement sensor 55 starts to be moved, and then two return positions are added, the movement time ts is calculated. The movement time calculation portion 123 send parts the movement time ts to the movement position calculation portion 124.

In the above ACT 5 to ACT 11, an operation is performed such that the temperature measurement sensor 55 passed through the two return positions is detected, and then the movement time ts between the return positions is obtained. Temperature control on the fixing member 51 is not performed during that time. This is so that a movement position of the temperature measurement sensor 55 can be determined on the basis of an actually measured value of the movement time ts as will be described later.

After ACT 11, ACT 12 is performed. In ACT 12, the same operation as in ACT 7 is performed.

After ACT 12, ACT 13 is performed. In ACT 13, the same operation as in ACT 8 is performed.

After ACT 13, ACT 14 is performed. In ACT 14, the same operation as in ACT 9 is performed.

However, in ACT 14, if the temperature measurement sensor 55 passed through the return position (ACT 14: YES), ACT 10 is performed. If the temperature measurement sensor 55 did not pass through the return position is determined (ACT 14: NO), ACT 15 is performed.

In ACT 15, a movement position P(t) is calculated on the basis of the movement time ts.

Specifically, the movement position calculation portion 124 calculates the movement position P(t) with the first return position as the origin boundary the following Equation (1) or (2).

$$P(t)=Ls\cdot t/ts \tag{1}$$

$$P(t)=Ls\cdot(ts-t)/ts \tag{2}$$

Here, Ls indicates a scanning width from the point P1 to the point P6.

Here, Equation (1) is used if the last return position is the first return position. Equation (2) is used if the last return position is the second return position.

After ACT 15, ACT 16 is performed. In ACT 16, it is determined whether or not the movement position P(t) is the heated region H.

Specifically, the movement position calculation portion 124 determines whether or not the movement position P(t) is the heated region H on the basis of position information of the heated region H stored in advance in the storage section 113. As in the present exemplary embodiment, if the heated region H is divided into a plurality of regions, the movement position calculation portion 124 specifies which one of the first heated region H1, the second heated region H2, and the third heated region H3 corresponds to the heated region H.

If the movement position P(t) is the heated region H (ACT 16: YES), the movement position calculation portion 124 send parts information regarding the movement position P(t) to the heating control portion 125. Thereafter, ACT 17 is performed.

If the movement position P(t) is not the heated region H (ACT 16: NO), ACT 18 is performed.

In ACT 17, temperature control on the fixing member 51 is performed.

Specifically, ACT 31 to ACT 34 are performed according to a flow in FIG. 11.

In ACT 31, the heating control portion 125 reads a set temperature Tf(P(t)) at the movement position P(t) from the storage section 113.

After ACT 31, ACT 32 is performed. In ACT 32, the heating control portion 125 determines whether or not T(t) is equal to or higher than Tf(P(t)).

If T(t)≥Tf(P(t)) (ACT 32: YES), ACT 33 is performed.

If T(t)<Tf(P(t)) (ACT 32: NO), ACT 34 is performed.

In ACT 33, the heating control portion 125 stops heating in the heating member 53.

As mentioned above, the temperature control operation is finished. The flow proceeds to ACT 18 in FIG. 9.

In ACT 34, the heating control portion 125 continuously performs heating using the heating member 53.

As mentioned above, the temperature control operation is finished. The flow proceeds to ACT 18 in FIG. 9.

In ACT 18, the heating control portion 125 determines whether or not a fixing-off signal is received from the system control section 111. The fixing-off signal is a control signal for stopping the fixing device 50.

If the fixing-off signal is received (ACT 18: YES), ACT 19 is performed.

If the fixing-off signal is not received (ACT 18: NO), ACT 13 is performed. In this case, as described above, ACT 13 to ACT 18 are performed, and thus temperature control on the fixing member 51 is performed on the basis of the set fixing temperature Tf(P(t)) at the movement position P(t) while the temperature measurement sensor 55 is scanning the heated region H.

In ACT 19, the heating control portion 125 stops heating in the heating member 53. The drive control section 127 stops the drive motor 59.

As mentioned above, the fixing temperature control method of the present exemplary embodiment is finished.

According to the fixing device, the image forming system, and the fixing temperature control method of the present exemplary embodiment, the temperature measurement sensor 55 is moved by the movement mechanism 56, and the temperature T(t) at the movement position P(t) of the fixing member 51 in the width direction is measured. The temperature T(t) is used for temperature control on the fixing member 51. In the fixing device 50 and the image forming system 100, temperature control can be performed on the basis of the set temperature Tf(P(t)) which is a target temperature at each position over the width direction of the fixing member 51 by using only the single temperature measurement sensor 55. A configuration of the fixing device 50 is simplified since a plurality of temperature measurement sensors are not used. Consequently, component cost for the fixing device 50 is reduced.

In the present exemplary embodiment, a position of the temperature measurement sensor 55 is measured on the basis of a temperature change measured by the temperature measurement sensor 55. A position measurement sensor which measures a position of the temperature measurement sensor 55 may not be provided, and thus a configuration of the fixing device 50 is simplified. Similarly, component cost for the fixing device 50 is reduced.

In the present exemplary embodiment, the movement position P(t) of the temperature measurement sensor 55 is determined on the basis of an actually measured value of the last movement time ts. Thus, even if mode switching or the like in which a fixing linear velocity is changed is performed, temperature control at an accurate position with delay of one scanning or less can be performed.

In the present exemplary embodiment, the movement mechanism 56 is driven by the drive motor 59 which drives the pressing member 52. A scanning speed of the temperature measurement sensor 55 is interlocked with a fixing linear velocity. Even if the fixing linear velocity is changed, a temperature control timing at each movement position is not relatively changed. Thus, an excessive increase or decrease in a temperature control interval due to a change of the fixing linear velocity is prevented.

Second Exemplary Embodiment

Next, a description will be made a fixing device and an image forming system according to a second exemplary embodiment with reference to the drawings.

Figure 12:
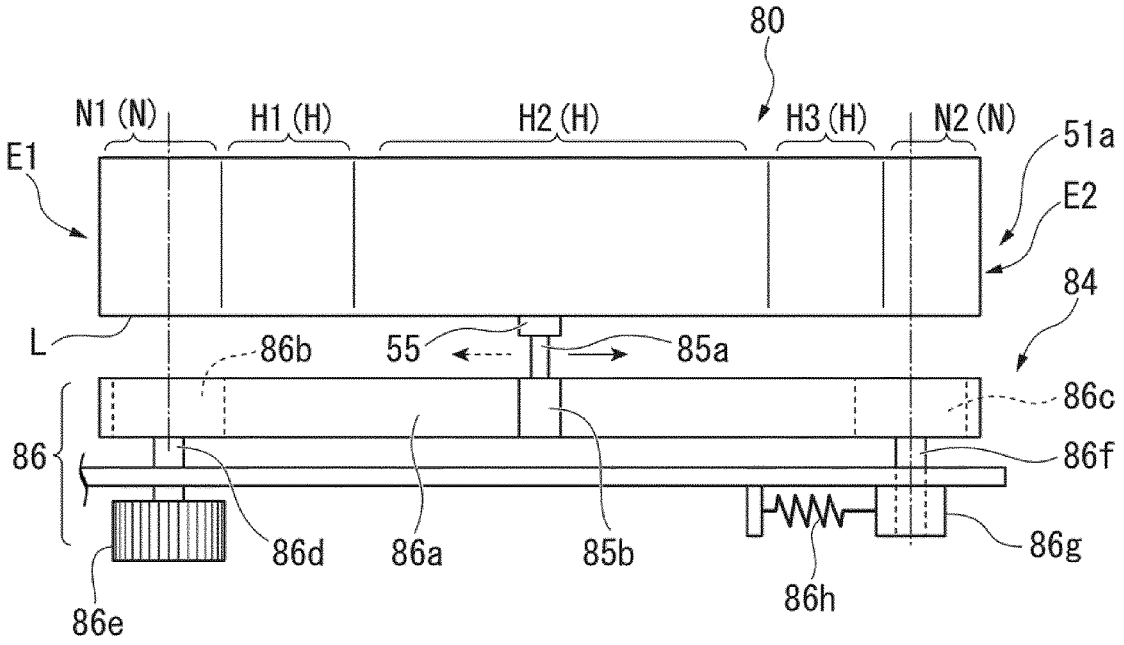
FIG. 12 is a schematic front view illustrating a configuration example of main portions of a fixing device of a second exemplary embodiment.
Figure 13:
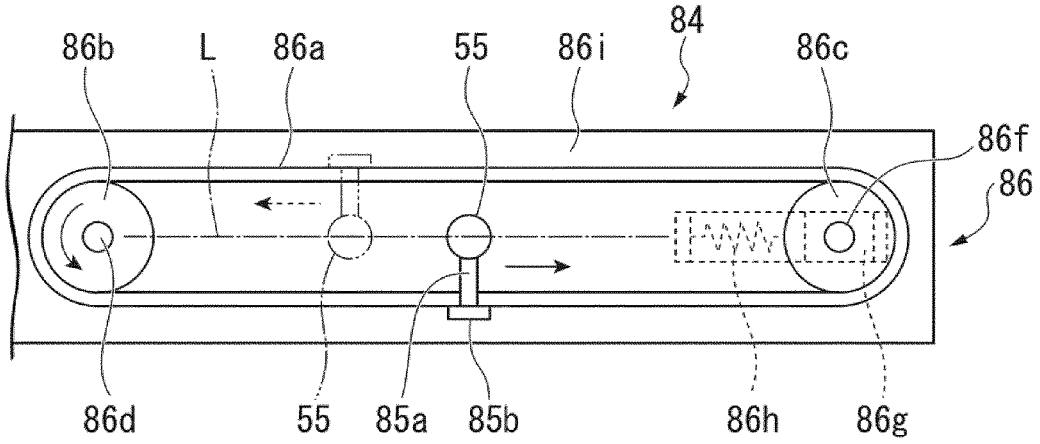
FIG. 13 is a schematic plan view illustrating a configuration example of main portions of a fixing device of a second exemplary embodiment.

FIG. 12 is a schematic front view illustrating a configuration example of main portions of a fixing device of the second exemplary embodiment. FIG. 13 is a schematic plan view illustrating a configuration example of the main portions of the fixing device of the second exemplary embodiment.

As illustrated in FIG. 12, an image forming system 200 of the present exemplary embodiment includes a fixing device 80 instead of the fixing device 50 of the image forming system 100 of the first exemplary embodiment. The fixing device 80 includes a temperature measurement unit 84 instead of the temperature measurement unit 54 of the fixing device 50 of the first exemplary embodiment.

Hereinafter, a description will be made focusing on a difference from the first exemplary embodiment.

As a configuration of the main portions of the fixing device 80 is illustrated in FIGS. 12 and 13, the temperature measurement unit 84 includes a movement mechanism 86 instead of the movement mechanism 56 of the first exemplary embodiment.

The temperature measurement sensor 55 of the present exemplary embodiment is disposed on the scanning line L by a support arm 85*a*. The support arm 85*a* is fixed to the movement mechanism 86 via a fixation portion 85*b*.

The movement mechanism 86 includes a support plate 86*i*, rotation shafts 86*d* and 86*f*, and a bearing portion 86*g*.

The support plate 86*i* supports the rotation shaft 86*d* to be rotatable about a central axis line thereof. The support plate 86*i* holds the bearing portion 86*g* such that a central axis line thereof is moved in parallel to the central axis line of the rotation shaft 86*d*. The bearing portion 86*g* is biased by a spring 86*h*. The rotation shaft 86*f* is inserted into the bearing portion 86*g*.

A driving pulley 86*b* and a gear 86*e* are provided at both end parts of the rotation shaft 86*d*.

A belt 86*a* such as a timing belt is wound on the driving pulley 86*b*.

The gear 86*e* is connected to the drive motor 59 (not illustrated) via a transmission mechanism (not illustrated). The gear 86*e* receives rotation drive force from the drive motor 59.

A driven pulley 86*c* is provided at an end part of the rotation shaft 86*f* opposite side to the bearing portion 86*g*.

The belt 86*a* is wound on the driven pulley 86*c*. The belt 86*a* is given tension caused by biasing force of the spring 86*h* acting on the bearing portion 86*g*.

Pitch circles of the driving pulley 86 band the driven pulley 86*c* are the same as each other. The belt 86*a* is hung in an elliptical shape circulating the rotation shafts 86*d* and 86*f*.

The fixation portion 85*b* is fixed onto the outer surface of the belt 86*a*. As illustrated in FIG. 13, the support arm 85*a* protrudes inward of the belt 86*a*. The support arm 85*a* is formed such that the center of the temperature measurement sensor 55 is located on a line segment connecting central axis lines of the rotation shafts 86*d* and 86*f* to each other regardless of a rotation position of the belt 86*a*.

The movement mechanism 86 is disposed such that the line segment connecting central axis lines of the rotation shafts 86*d* and 86*f* to each other overlaps the scanning line L in a plan view. The movement mechanism 86 is disposed such that the temperature measurement sensor 55 faces the outer surface of the fixing member 51.

The fixing device 80 includes the temperature measurement unit 84, and thus the driving pulley 86*b* is rotated due to rotation of the drive motor 59. The belt 86*a* is rotated due to the rotation of the driving pulley 86*b*. For example, the belt 86*a* is continuously rotated counterclockwise in FIG. 13.

The fixation portion 85*b*, the support arm 85*a*, and the temperature measurement sensor 55 are also moved along with the belt 86*a*. The temperature measurement sensor 55 repeatedly and reciprocally moved on the scanning line L.

In the fixing device 80, the temperature measurement sensor 55 is moved by the movement mechanism 86 in the same manner as in the first exemplary embodiment. Thus, the same fixing temperature control method as in the first exemplary embodiment can be performed.

Also in the fixing device 80 and the image forming system 200 of the present exemplary embodiment, temperature control can be performed on the basis of the set temperature Tf(P(t)) which is a target temperature at each position over the width direction of the fixing member 51 by using only the single temperature measurement sensor 55. A configuration of the fixing device 80 is simplified since a plurality of temperature measurement sensors are not used. Similarly, component cost for the fixing device 80 is reduced.

Also in the present exemplary embodiment, a position measurement sensor which measures a position of the temperature measurement sensor 55 may not be provided, and thus a configuration of the fixing device 80 is simplified. Similarly, component cost for the fixing device 80 is reduced.

Hereinafter, modification examples of the exemplary embodiments will be described.

In the exemplary embodiment, an example in which the heating member 53 is disposed inside the fixing belt 51*a* was described. However, a position of the heating member is not particularly limited as long as the fixing member can be heated. For example, the heating member may be disposed inside the fixing member 51.

In the exemplary embodiment, an example in which the number of heated regions H is three was described. However, the heated region H may be formed of one or two regions, and may be formed of four or more regions. If a plurality of heated regions H are provided, a division method is not particularly limited. For example, regarding a division method, the heated region H may be equally divided, or may be divided according to methods other than equal division. Regarding a division method for the heated region H, the heated region may be divided to be linearly symmetric with respect to a central axis line of the entire heated region in the width direction of the fixing member, and may be divided to be asymmetric.

In the exemplary embodiment, an example in which an end part determination is performed on the basis of a temperature change measured by the temperature measurement sensor 55 was described. However, a passage detection sensor for the temperature measurement sensor 55 may be provided near the first return position or the second return position. In this case, whether a return position is the first return position or the second return position can be determined on the basis of the presence or absence of detection in the passage detection sensor.

If the passage detection sensor is provided, the passage detection sensor may be used to detect a home position of a movement mechanism. In this case, an operation of returning the temperature measurement sensor 55 to a home position may be performed when the image forming system 100 is activated, and a fixing operation is finished (ACT 9 in FIG. 9). In the above-described way, a movement starting position of the temperature measurement sensor 55 is invariable, some of the operations in FIG. 9 related to an end part determination can be simplified. For example, ACT 5 to ACT 7 may be omitted.

In the exemplary embodiment, an example was described in which an end part determination is performed whenever the temperature measurement sensor 55 passes through the return position. In this end part determination, the first return position or the second return position is determined every time. However, if either one of the return positions is determined at least in an initial end part determination, then, a movement position may be calculated by changing the return position.

In the exemplary embodiment, an example was described in which the width d1 of the first non-heated region N1 is larger than the width d5 of the second non-heated region N2 such that a distance between the point P1 and the point P2 is longer than a distance between the point P5 and the point P6. However, the width d1 may be equal to or smaller than the width d5 as long as a distance between the point P1 and the point P2 can be made longer than a distance between the point P5 and the point P6.

However, even if a distance between the point P1 and the point P2 is shorter than a distance between the point P5 and the point P6, the fixing temperature control method of the exemplary embodiment can be performed.

According to at least one of the above-described exemplary embodiments, the fixing device includes the fixing member, the temperature measurement sensor, the movement mechanism, the movement time calculation portion, the movement position calculation portion, and the temperature control section. The movement mechanism scans the non-heated region and the heated region along the width direction of the fixing member, and thus the movement time calculation portion can obtain arrival time to the first end part and the second end part in the scanning range of the movement mechanism on the basis of a temperature change measured by the temperature measurement sensor. The movement position calculation portion can calculate a movement position on the fixing member on the basis of a ratio between time for which the temperature measurement sensor is moved between the first end part and the second end part, and time for which the temperature measurement sensor is moved to a movement position thereof.

According to the exemplary embodiments, a temperature at each movement position of the temperature measurement sensor can be measured even with a simple and cheap configuration in which a position measurement sensor for the temperature measurement sensor is not provided.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a fixing member having non-heated regions formed at a first end part and a second end part of the fixing member, and a heated region interposed between the non-heated regions;

a temperature measurement sensor configured to measure the temperature of a surface of the fixing member;

a movement mechanism configured to move the temperature measurement sensor to scan the non-heated regions and the heated region along a width direction of the fixing member;

a movement time calculation section configured to calculate a first movement time for when the temperature measurement sensor is moved between the first end part and the second end part based on a temperature change measured by the temperature measurement sensor due to movement of the temperature measurement sensor, and calculate a second movement time for when the temperature measurement sensor is moved from the first end part or the second end part to a movement position of the temperature measurement sensor based on a temperature change measured by the temperature measurement sensor due to movement of the temperature measurement sensor;

a movement position calculation section configured to calculate the movement position of the temperature measurement sensor on the basis of a ratio of the second movement time to the first movement time; and a temperature control section configured to perform temperature control on the fixing member on the basis of the movement position calculated by the movement position calculation section, and the temperature measured by the temperature measurement sensor at the movement position.

2. The device according to claim 1, wherein the movement mechanism includes:

a motor, and a cam mechanism configured to convert rotational motion of an output shaft of the motor into reciprocating linear motion.

3. The device according to claim 2, wherein the cam mechanism includes:

a cylindrical cam configured to have a spiral cam groove; and a follower configured to be engaged with the spiral cam groove, and be guided by a linear guide along the width direction of the fixing member, wherein the temperature measurement sensor is fixed to the follower.

4. The device according to claim 3, wherein the spiral cam groove is configured to have a continuous loop at both end parts of the cylindrical cam in an axial direction of the cylindrical cam.

5. The device according to claim 4, further comprising:

an engagement portion of the follower having a length along a longitudinal direction of the spiral cam groove larger than a groove width of the spiral cam groove, the engagement portion being configured to engage the follower with the spiral cam groove, wherein the spiral cam groove includes spiral grooves with different inclined directions intersecting each other.

6. The device according to claim 1, wherein the movement time calculation section obtains an arrival time of the temperature measurement sensor to the first end part or the second end part by estimating a minimum value of the temperature change when the temperature measurement sensor measures a temperature reduction exceeding a predefined first threshold value and then measures a temperature increase exceeding a second threshold value.

7. The device according to claim 1, wherein scanning widths of the non-heated regions scanned with the temperature measurement sensor are different from each other.

8. The device according to claim 1, wherein the movement time calculation section updates the first movement time whenever scanning between the first end part and the second end part is finished, and wherein the movement position calculation section calculates the movement position on the basis of the first movement time updated by the movement time calculation section.

9. An image forming system comprising the fixing device according to claim 1.

10. A fixing temperature control method comprising:

providing a fixing member having non-heated regions formed at a first end part and a second end part of the fixing member in a width direction, and a heated region interposed between the non-heated regions;

scanning the non-heated regions and the heated region of the fixing member in the width direction using a temperature measurement sensor;

calculating a first movement time for when the temperature measurement sensor is moved between the first end part and the second end part based on a temperature change measured by the temperature measurement sensor due to movement of the temperature measurement sensor;

calculating a second movement time for when the temperature measurement sensor is moved from the first end part or the second end part to a movement position of the temperature measurement sensor based on a temperature change measured by the temperature measurement sensor due to movement of the temperature measurement sensor;

calculating the movement position of the temperature measurement sensor on the basis of a ratio of the second movement time to the first movement time; and performing temperature control on the fixing member on the basis of the calculated movement position, and the temperature measured by the temperature measurement sensor at the movement position.

11. The fixing temperature control method according to claim 10, wherein the movement mechanism includes a motor and a cam mechanism, the method further comprising:

converting a rotational motion of an output shaft of the motor into reciprocating linear motion using the cam mechanism.

12. The fixing temperature control method according to claim 11, wherein the cam mechanism includes a cylindrical cam having a spiral cam groove and a follower, the method further comprising:

engaging the follower with the spiral cam groove;

guiding the follower by a linear guide along the width direction of the fixing member; and fixing the temperature measurement sensor to the follower.

13. The fixing temperature control method according to claim 12, wherein the spiral cam groove is configured to have a continuous loop at both end parts of the cylindrical cam in an axial direction of the cylindrical cam.

14. The fixing temperature control method according to claim 13, further comprising:

engaging the follower with the spiral cam groove using an engagement portion of the follower, wherein the engagement portion comprises a length along a longitudinal direction of the spiral cam groove larger than a groove width of the spiral cam groove, and wherein the spiral cam groove includes spiral grooves with different inclined directions intersecting each other.

15. The fixing temperature control method according to claim 10, further comprising:

obtaining arrival times of the temperature measurement sensor to the first end part or the second end part by estimating a minimum value of the temperature change when the temperature measurement sensor measures a temperature reduction exceeding a predefined first threshold value and then measures a temperature increase exceeding a second threshold value.

16. The fixing temperature control method according to claim 10, wherein scanning widths of the non-heated regions scanned with the temperature measurement sensor are different from each other.

17. The fixing temperature control method according to claim 10, further comprising:

updating the first movement time whenever scanning between the first end part and the second end part is finished; and calculating the movement position on the basis of the updated first movement time.

18. A fixing device comprising:

a fixing belt or roller having non-heated regions formed at a first end part and a second end part of the fixing belt or roller, and a heated region interposed between the non-heated regions;

a temperature measurement sensor configured to measure the temperature of a surface of the fixing belt or roller;

a guide configured to move the temperature measurement sensor to scan the non-heated regions and the heated region along a width direction of the fixing belt or roller; and a fixing controller configured to calculate a first movement time for when the temperature measurement sensor is moved between the first end part and the second end part based on a temperature change measured by the temperature measurement sensor due to movement of the temperature measurement sensor;

calculate a second movement time for when the temperature measurement sensor is moved from the first end part or the second end part to a movement position of the temperature measurement sensor based on a temperature change measured by the temperature measurement sensor due to movement of the temperature measurement sensor;

calculate the movement position of the temperature measurement sensor on the basis of a ratio of the second movement time to the first movement time; and perform temperature control on the fixing belt or roller on the basis of the calculated movement position and the temperature measured by the temperature measurement sensor at the movement position.

* * * * *